US012584679B2

(12) United States Patent
Park et al.

(10) Patent No.: US 12,584,679 B2
(45) Date of Patent: Mar. 24, 2026

(54) REFRIGERATOR INCLUDING A DETECTION SENSOR AT AN AIR DISCHARGE SIDE OF A BLOWING FAN

(71) Applicant: LG ELECTRONICS INC., Seoul (KR)

(72) Inventors: Kyong Bae Park, Seoul (KR); Sung Jhee, Seoul (KR); Yun Su Cho, Seoul (KR); Young Seung Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 73 days.

(21) Appl. No.: 18/290,390

(22) PCT Filed: May 23, 2022

(86) PCT No.: PCT/KR2022/007310
§ 371 (c)(1),
(2) Date: Nov. 13, 2023

(87) PCT Pub. No.: WO2022/270772
PCT Pub. Date: Dec. 29, 2022

(65) Prior Publication Data

US 2024/0263868 A1 Aug. 8, 2024

(30) Foreign Application Priority Data

Jun. 24, 2021 (KR) ..... 10-2021-0082390

(51) Int. Cl.
*F25D 21/02* (2006.01)
*F25D 17/06* (2006.01)
(Continued)

(52) U.S. Cl.
CPC ..... *F25D 21/02* (2013.01); *F25D 17/067* (2013.01); *F25D 17/065* (2013.01); *F25D 17/08* (2013.01); *F25D 21/06* (2013.01)

(58) Field of Classification Search
CPC .... F25D 17/045; F25D 17/062; F25D 17/065; F25D 21/06; F25D 17/067; F25D 17/08;
(Continued)

(56) References Cited

U.S. PATENT DOCUMENTS 3,643,457 A * 2/1972 Winkler ..... F24F 5/001 62/151
2013/0000333 A1* 1/2013 Kim ..... F25D 17/065 62/407
2019/0277554 A1* 9/2019 Park ..... F25D 21/00

FOREIGN PATENT DOCUMENTS

KR 20050006000 A * 1/2005 ..... F25D 21/08
KR 100880483 B1 * 1/2009 ..... F25D 29/00
WO WO-0106248 A2 * 1/2001 ..... F25D 17/042

* cited by examiner

*Primary Examiner* — Jerry-Daryl Fletcher
*Assistant Examiner* — Daniel C Comings
(74) *Attorney, Agent, or Firm* — Bryan Cave Leighton Paisner LLP

(57) ABSTRACT

A refrigerator includes a grille assembly having a blowing fan installed at one side of a first storage compartment to discharge air heat-exchanged with a cooling source to at least one of the first and second storage compartment. The grille assembly includes a first guide flow path for guiding air flow from the blowing fan to the first storage compartment, and a second guide flow path for guiding air flow from the blowing fan to the second storage compartment. A first damper is located at the first guide flow path and a second damper is located at the second guide flow path. A detection sensor is installed at an air discharge side of the blowing fan and installed in at least one part of the second guide flow path, and the detection sensor is installed at an air outlet side of the second damper in the second guide flow path.

21 Claims, 38 Drawing Sheets

(51) Int. Cl.
*F25D 17/08* (2006.01)
*F25D 21/06* (2006.01)

(58) Field of Classification Search
CPC ..... F25D 21/02; F25D 2317/06; F25D 2317/063; F25D 2317/067
See application file for complete search history.

[FIG. 1]
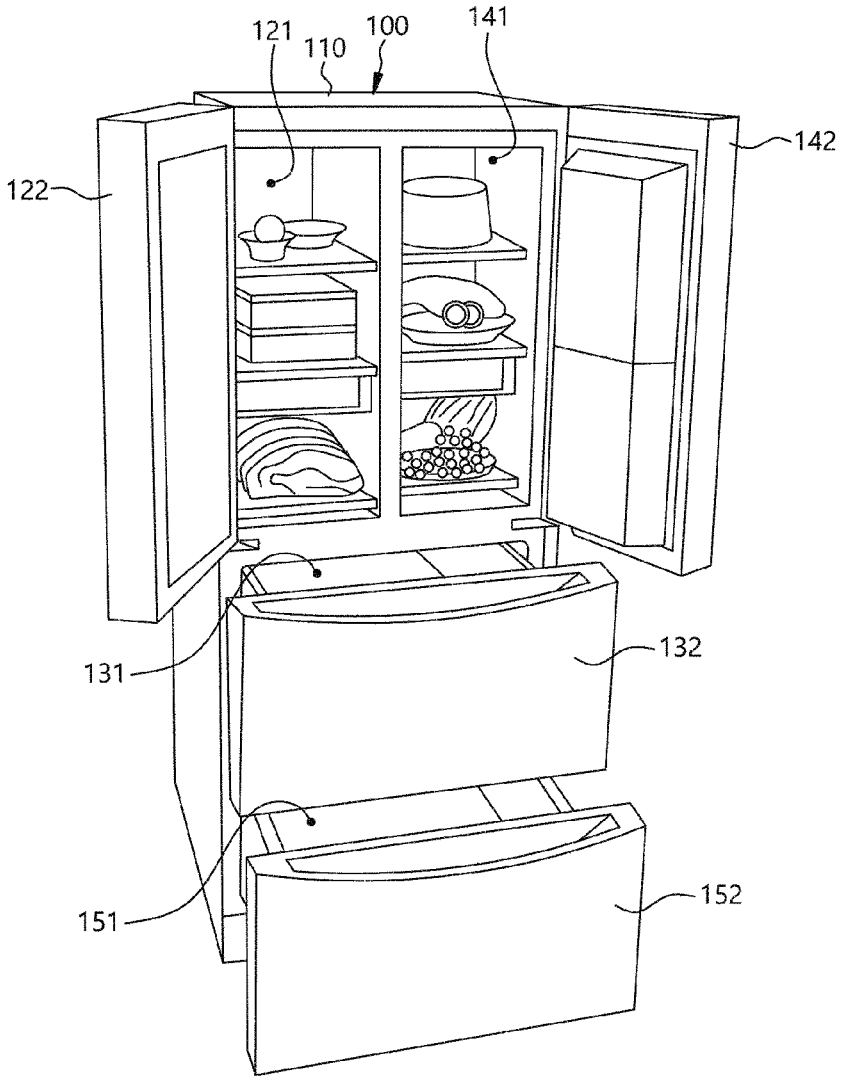

[FIG. 2]
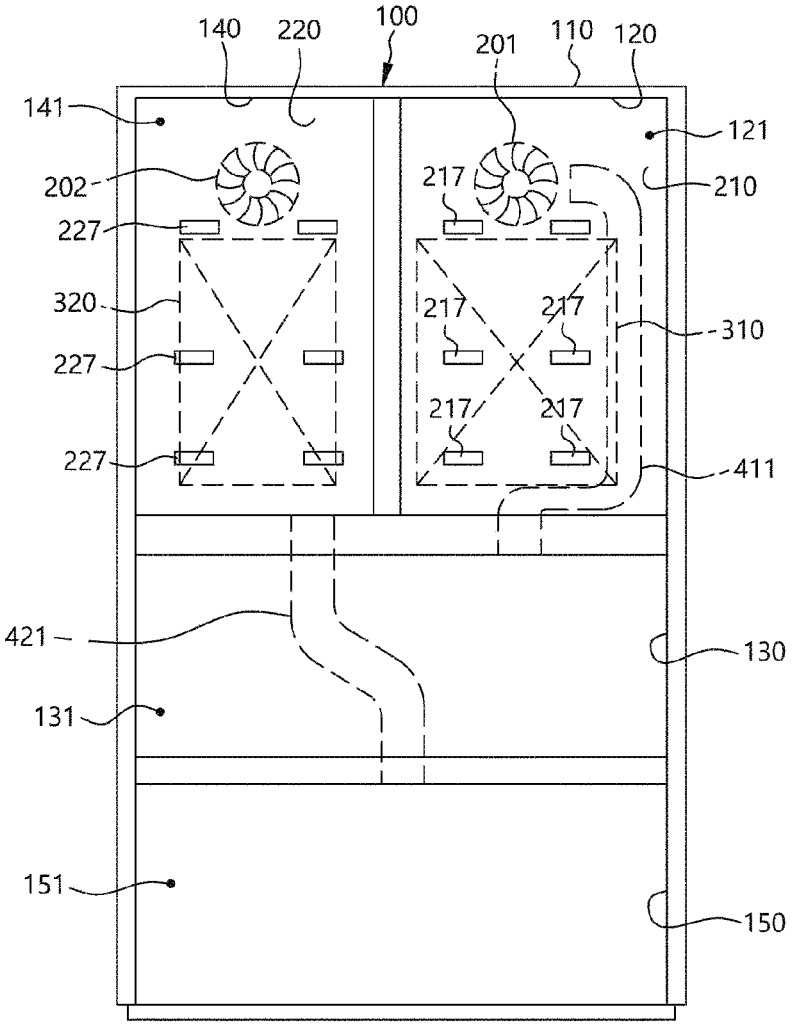

[FIG. 3]
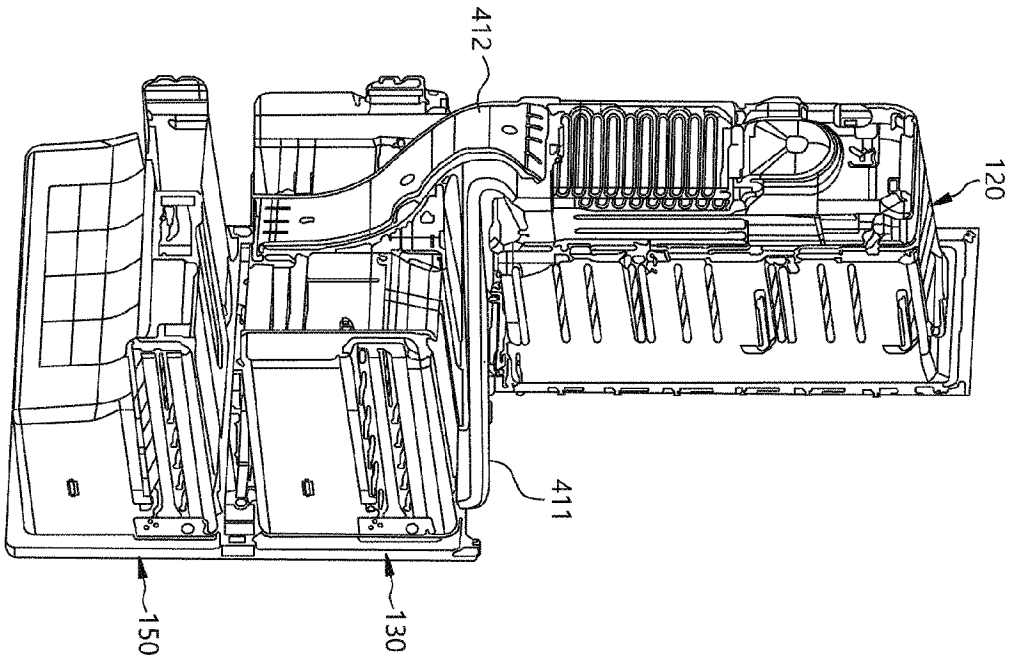

[FIG. 4]
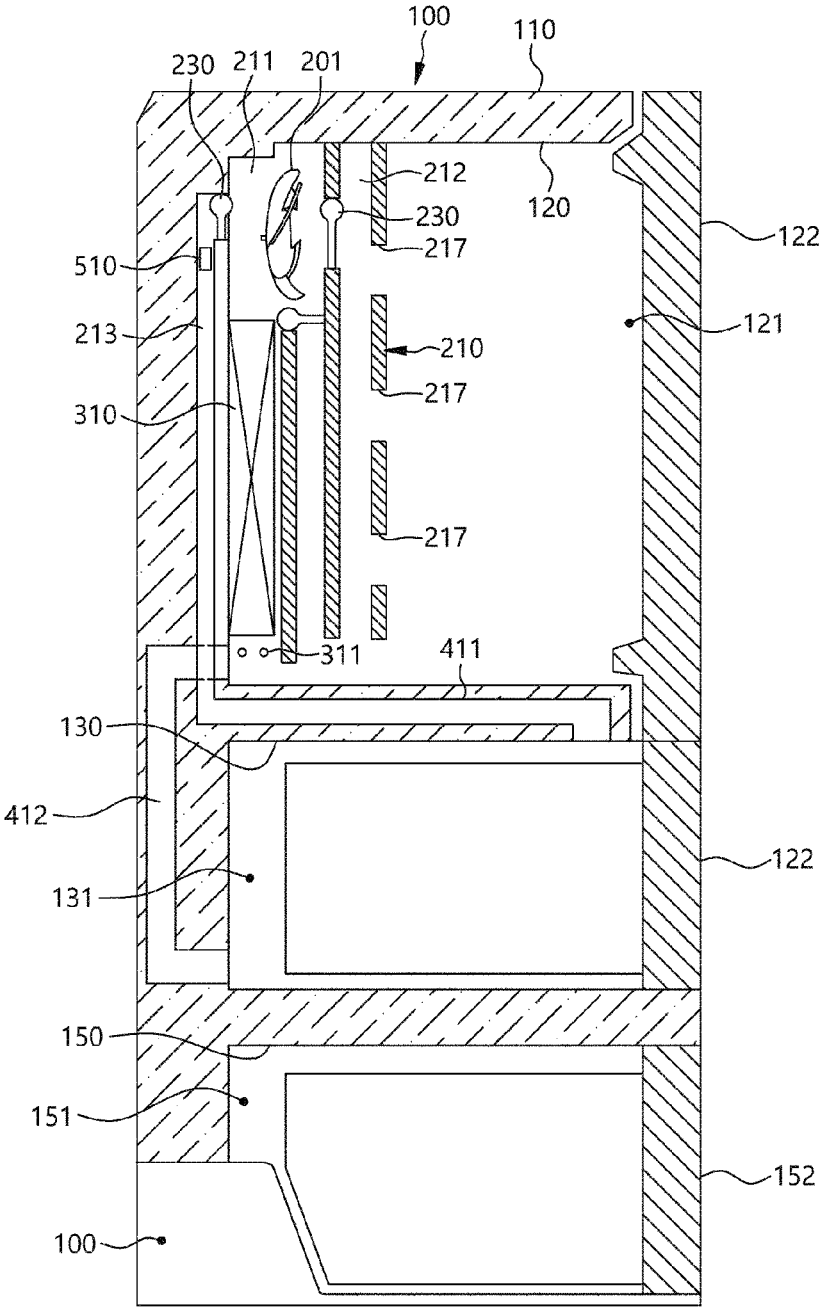

[FIG. 5]
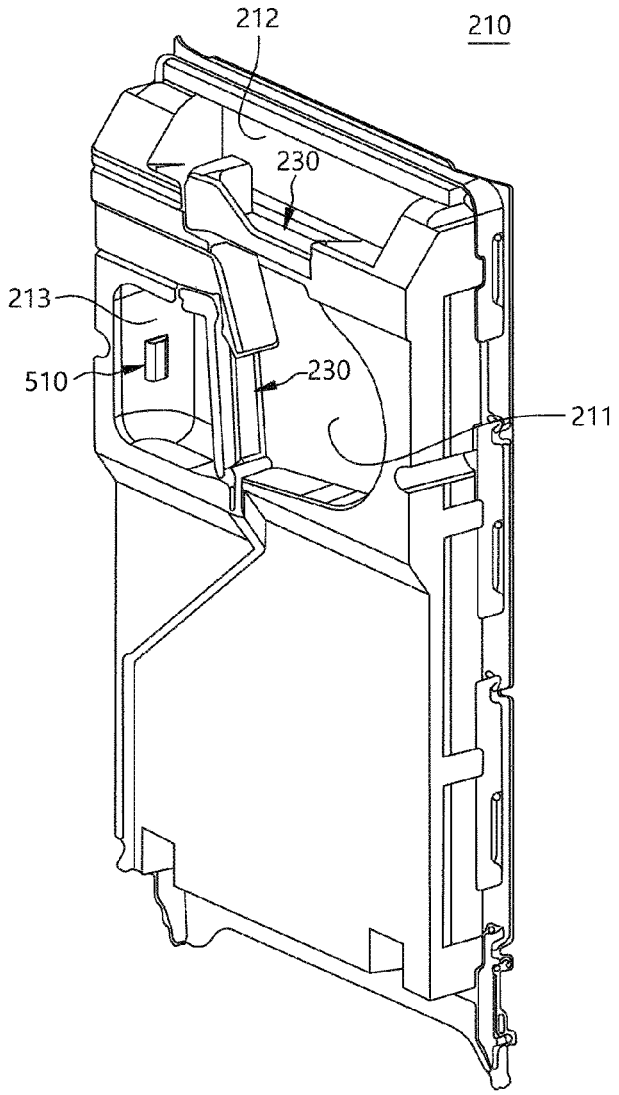

[FIG. 6]
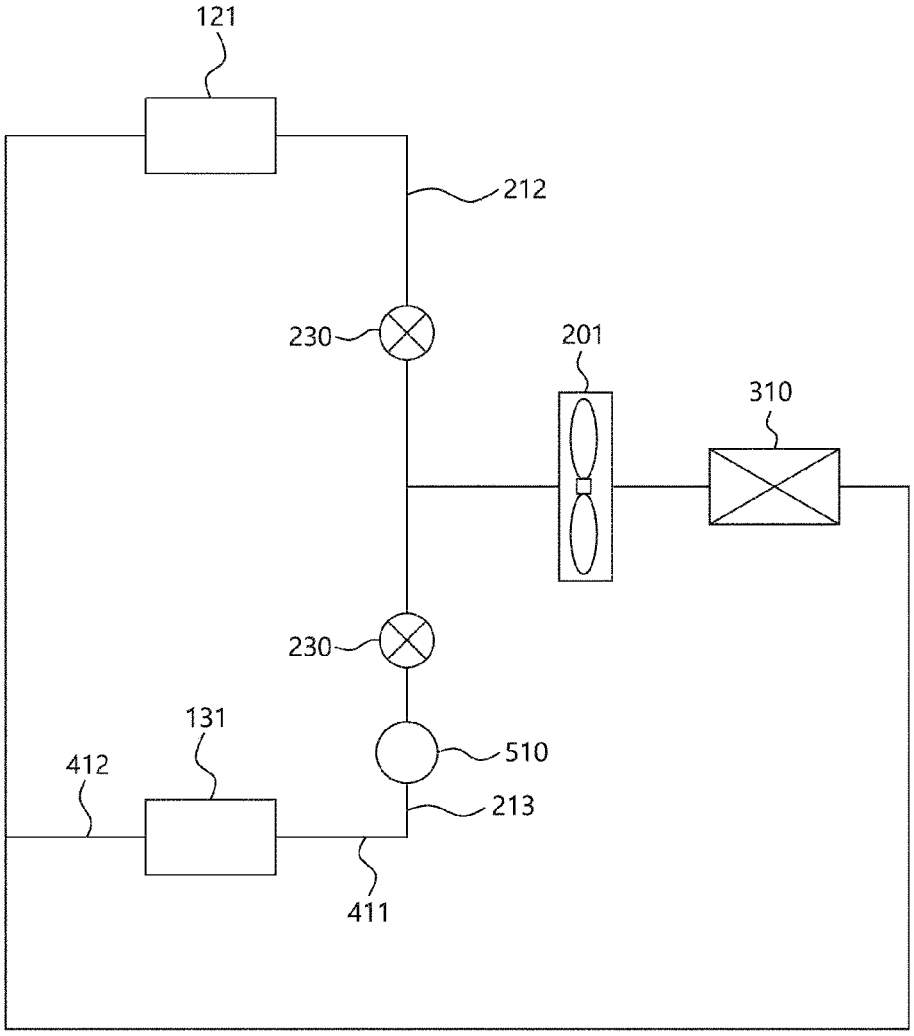

[FIG. 7]
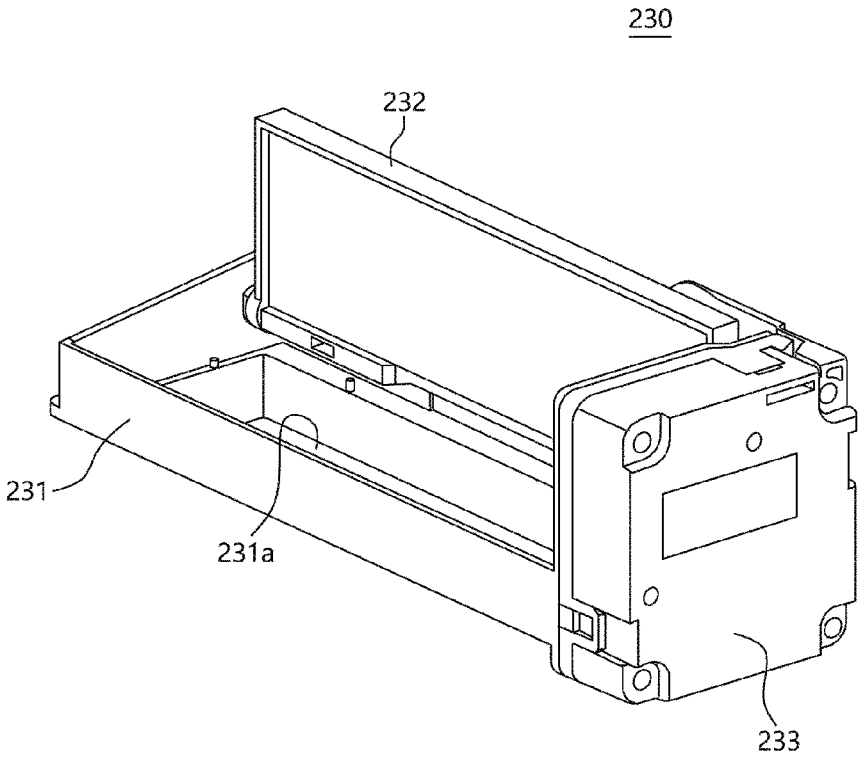
[FIG. 8]
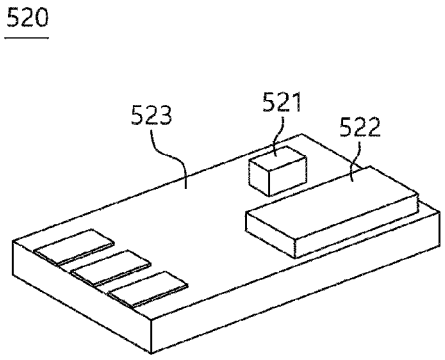

[FIG. 9]
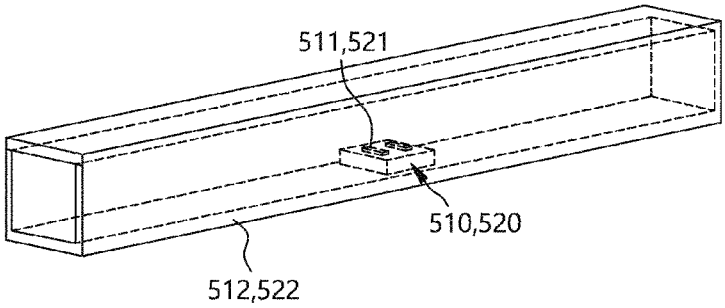
[FIG. 10]
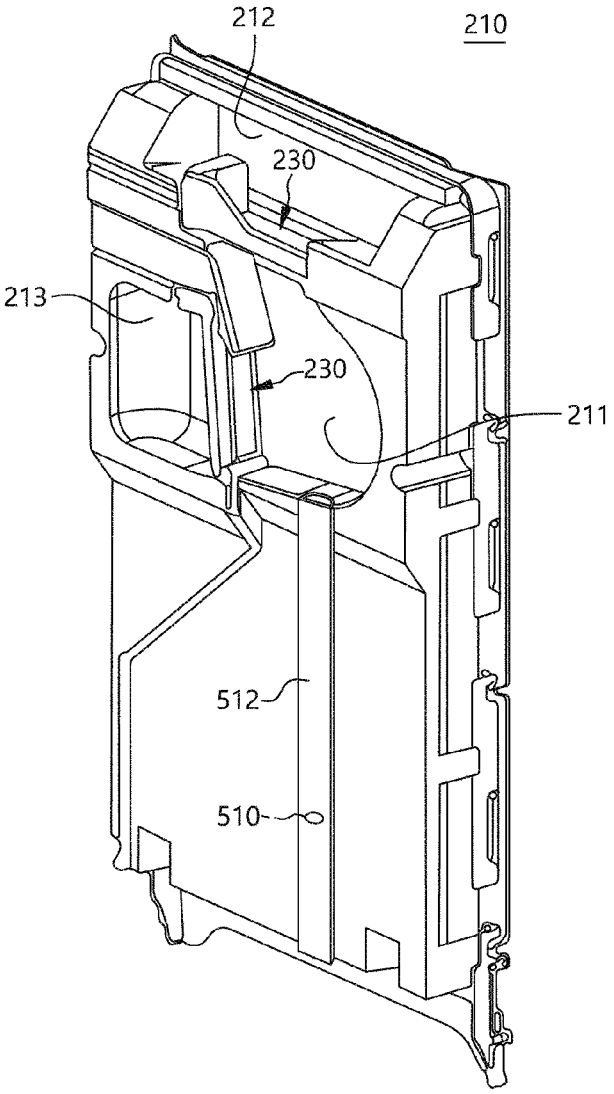

[FIG. 11]
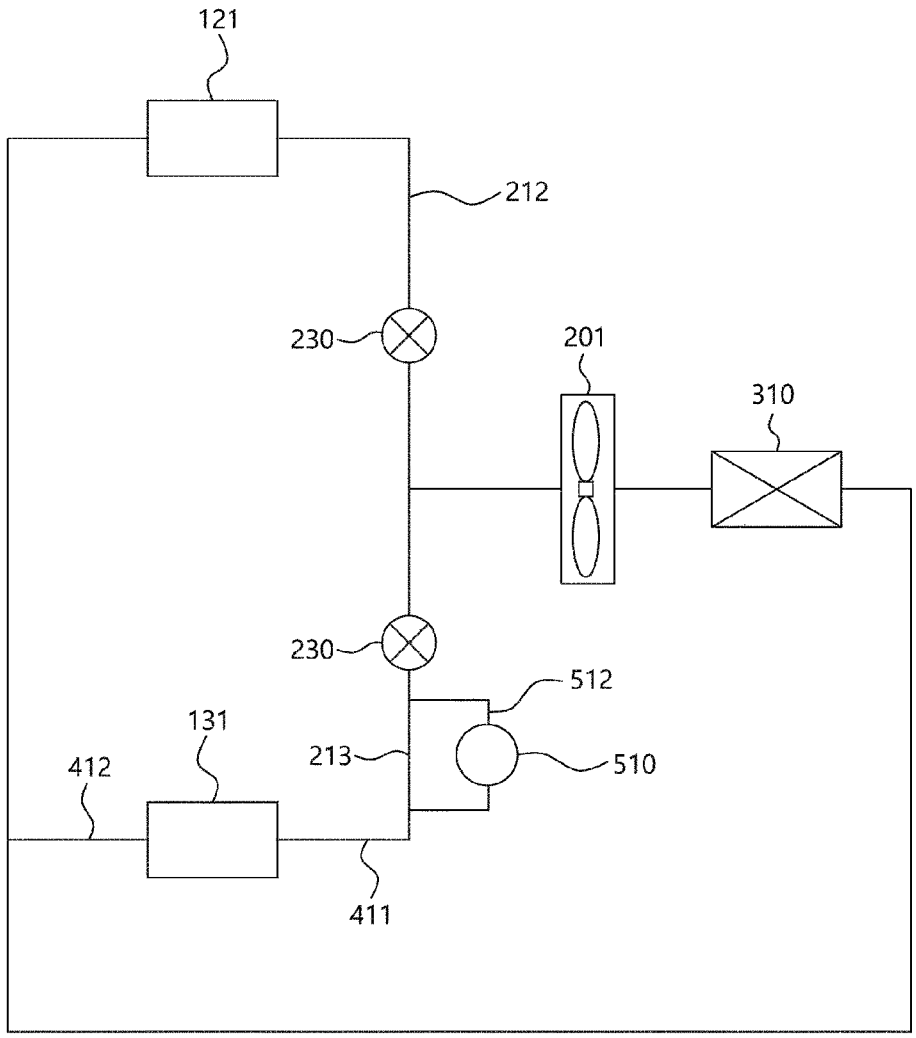

[FIG. 12]
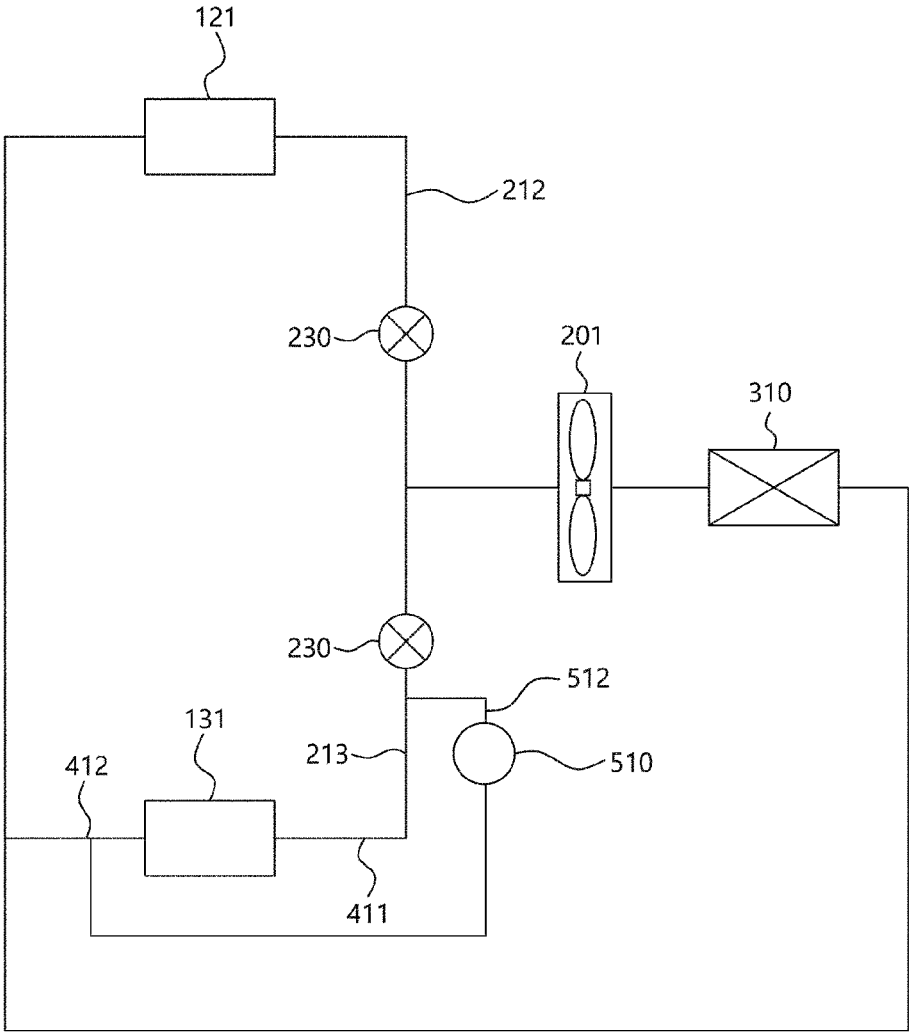

[FIG. 13]
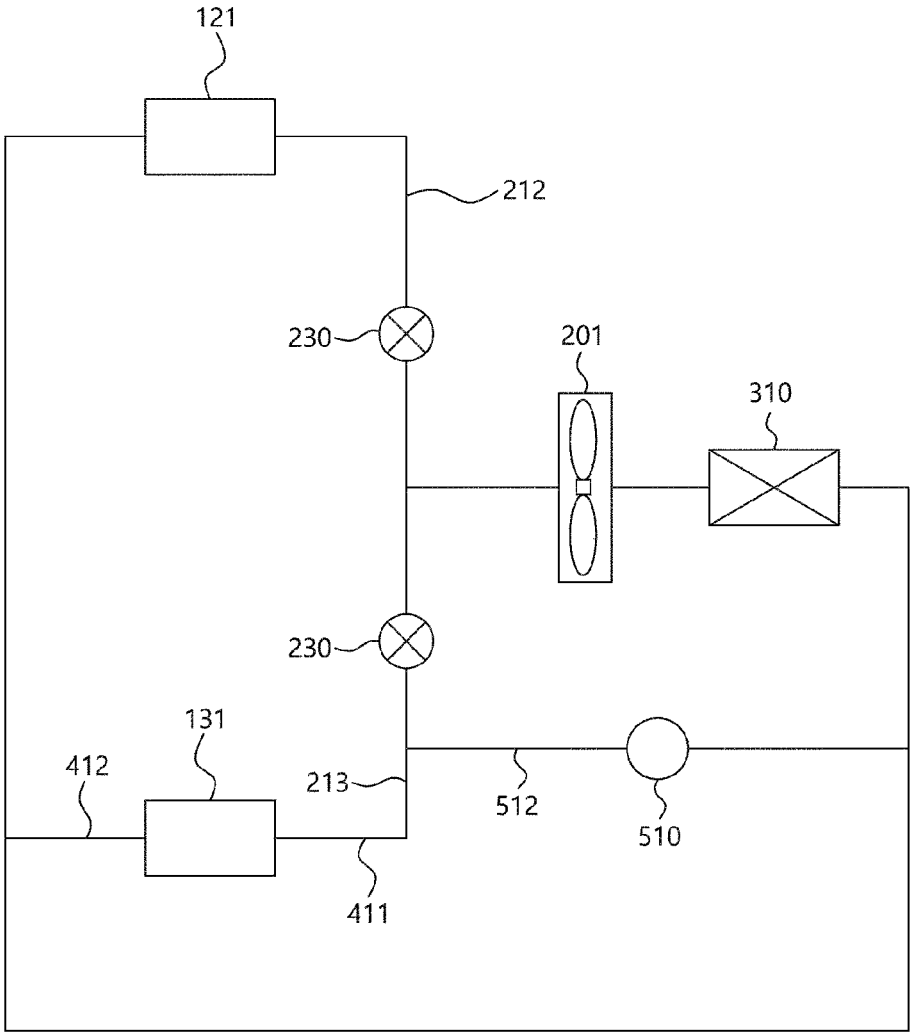

[FIG. 14]
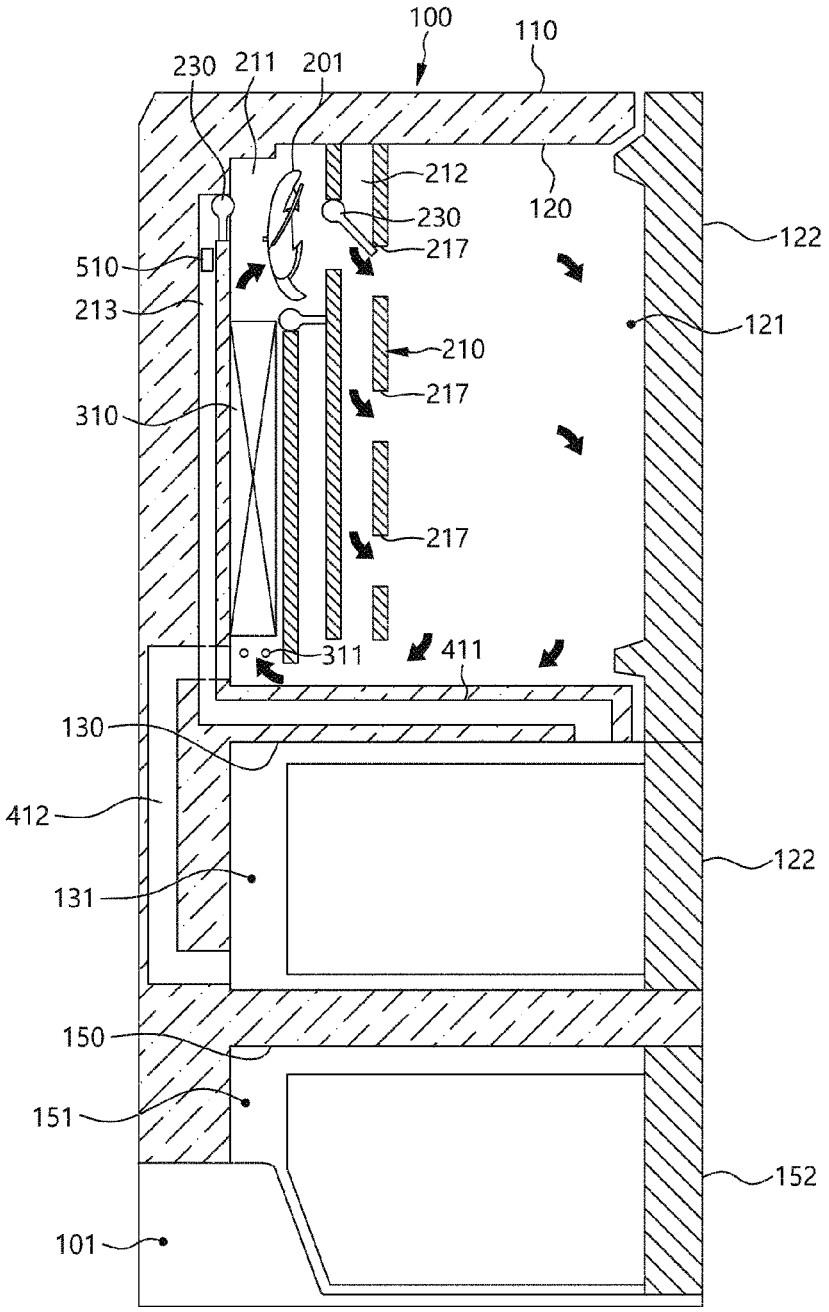

[FIG. 15]
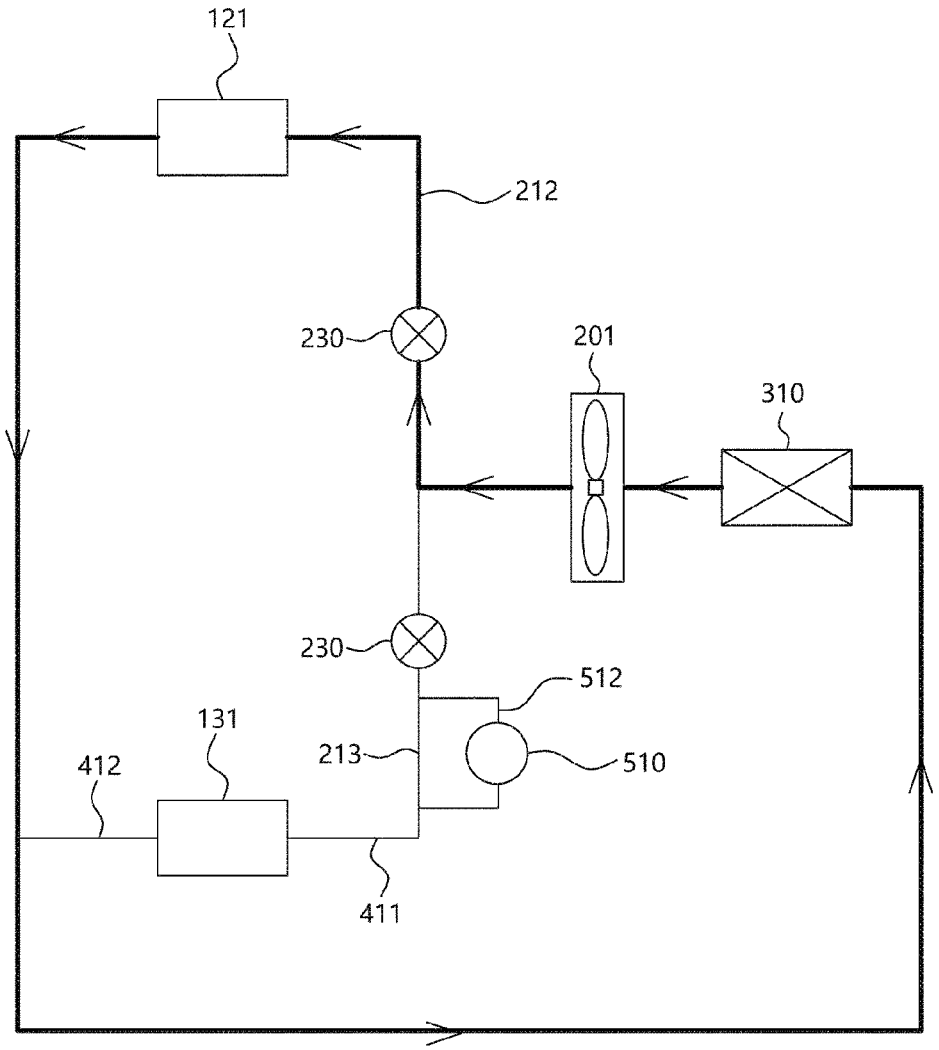

[FIG. 16]
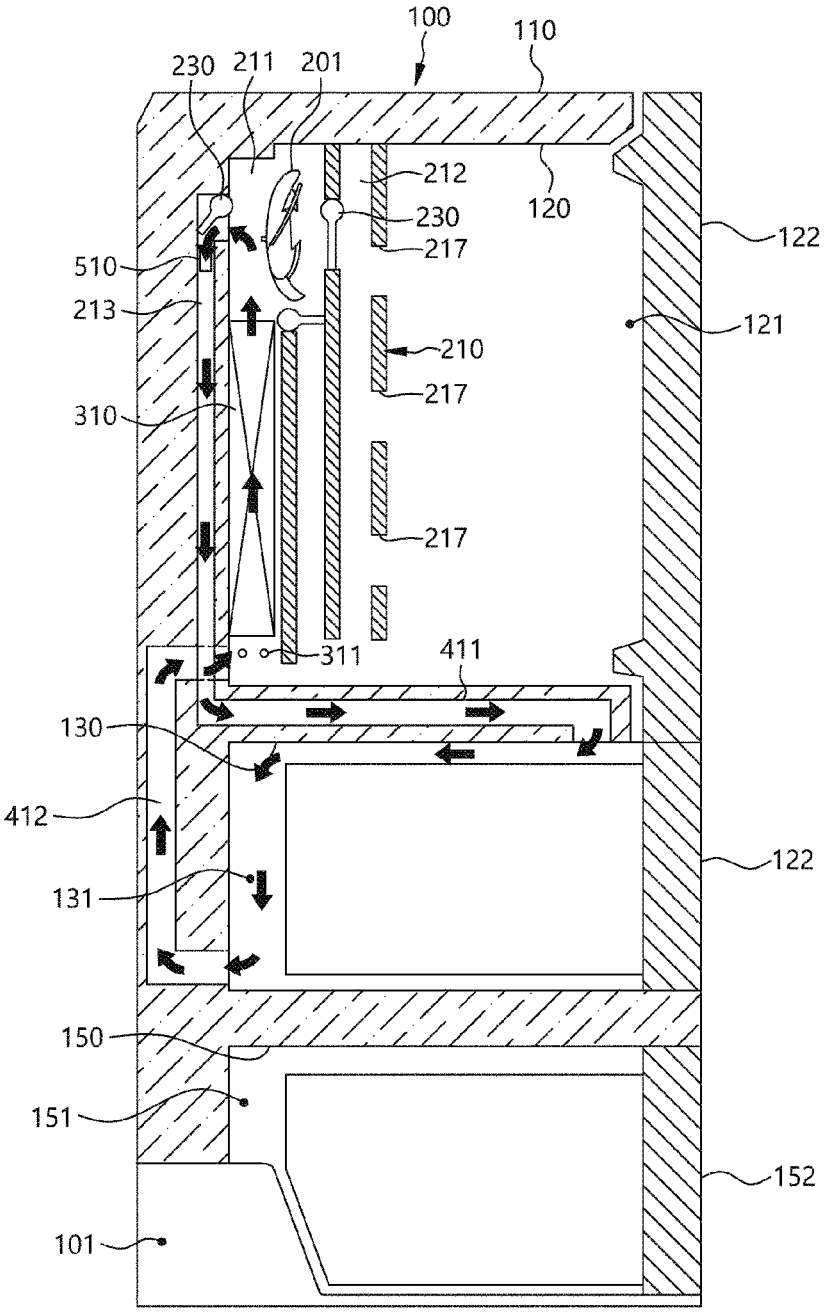

[FIG. 17]
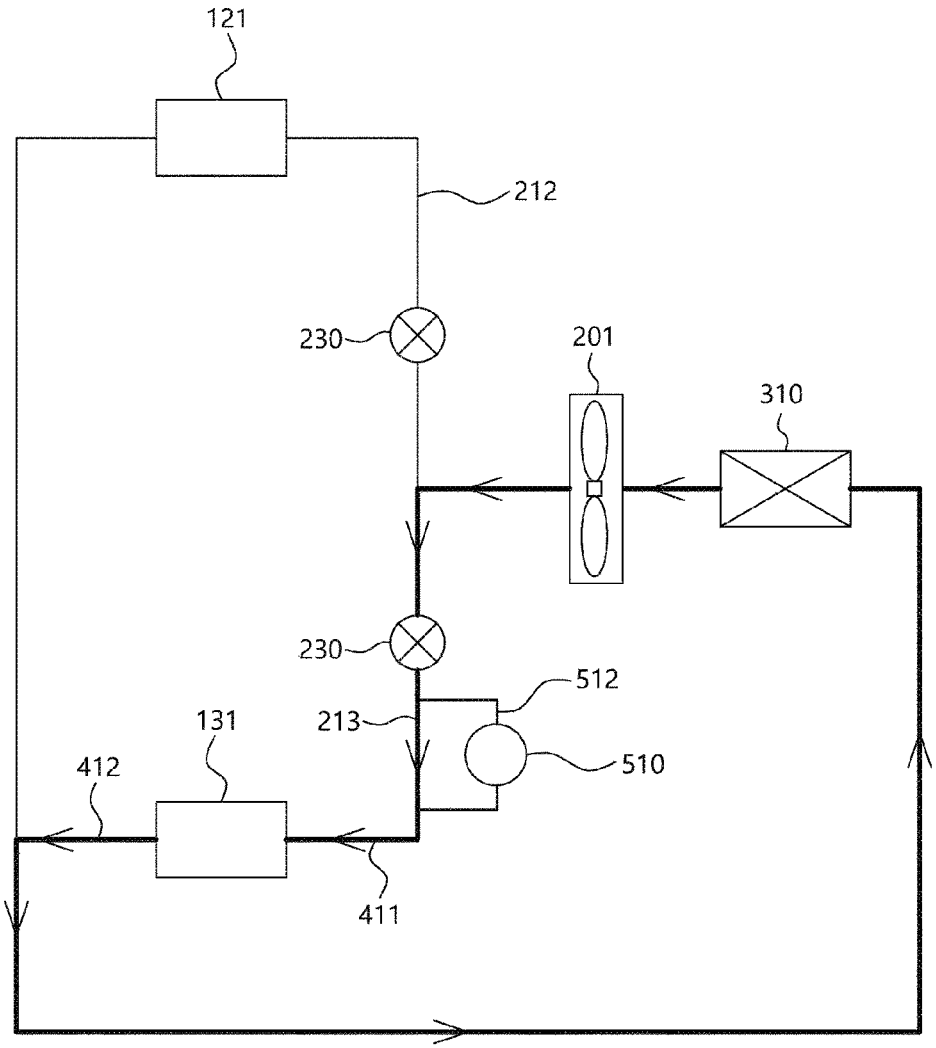

[FIG. 18]
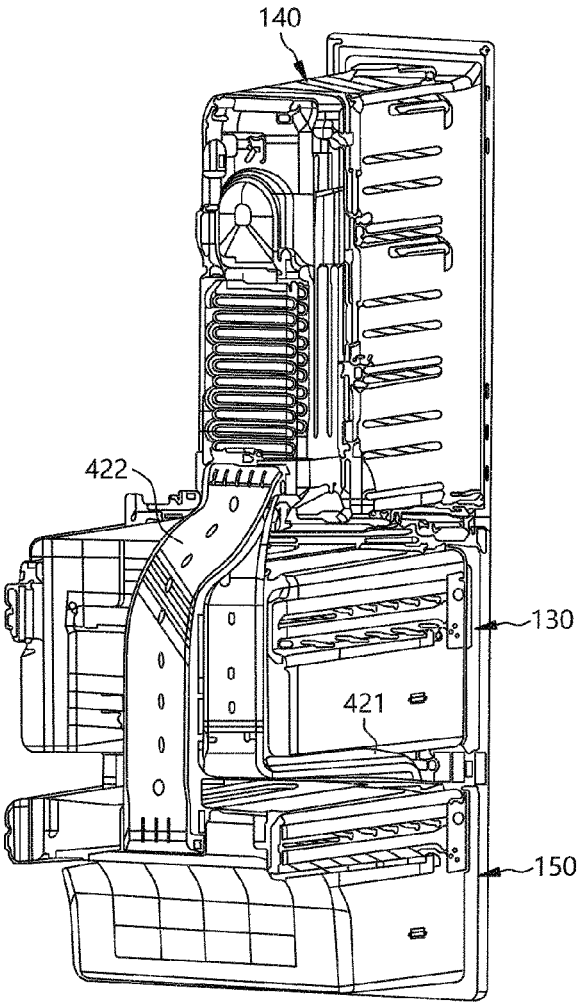

[FIG. 19]
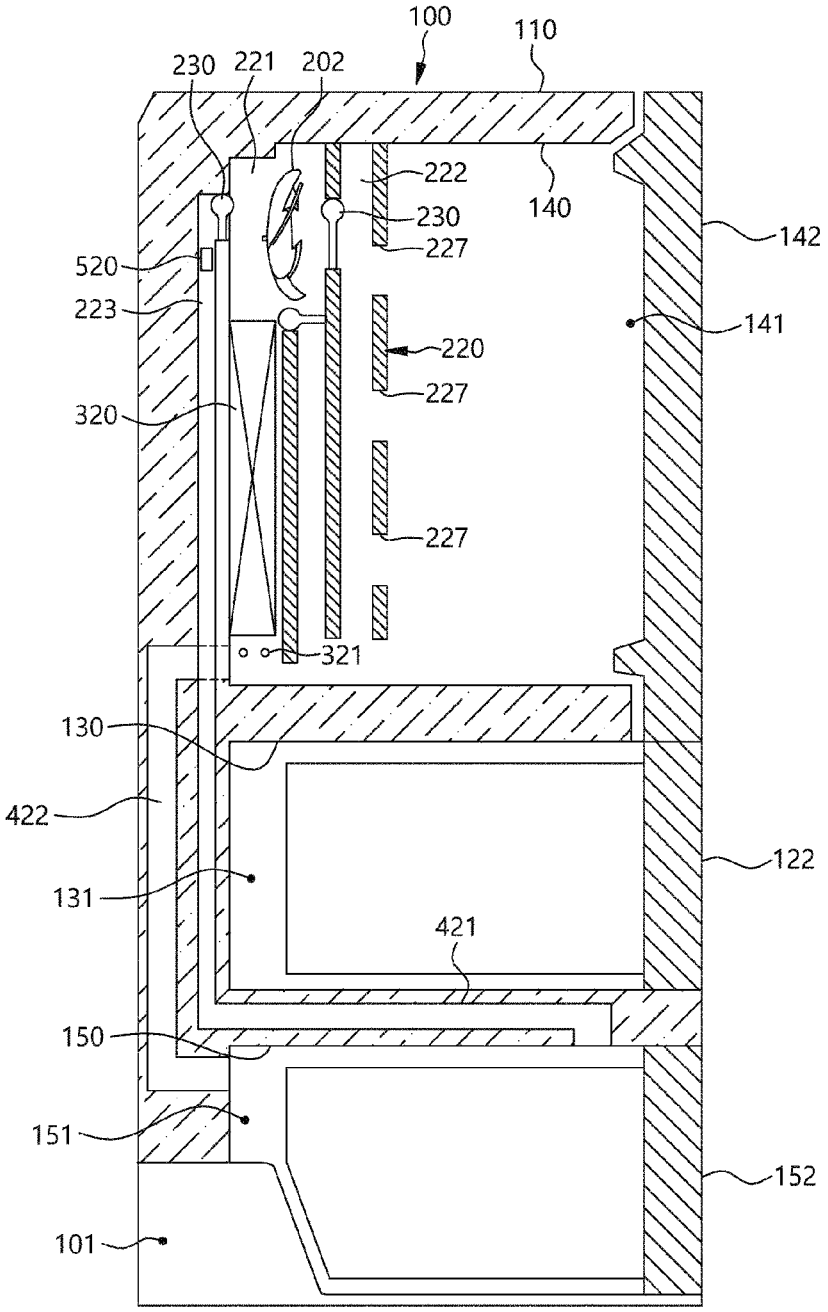

[FIG. 20]
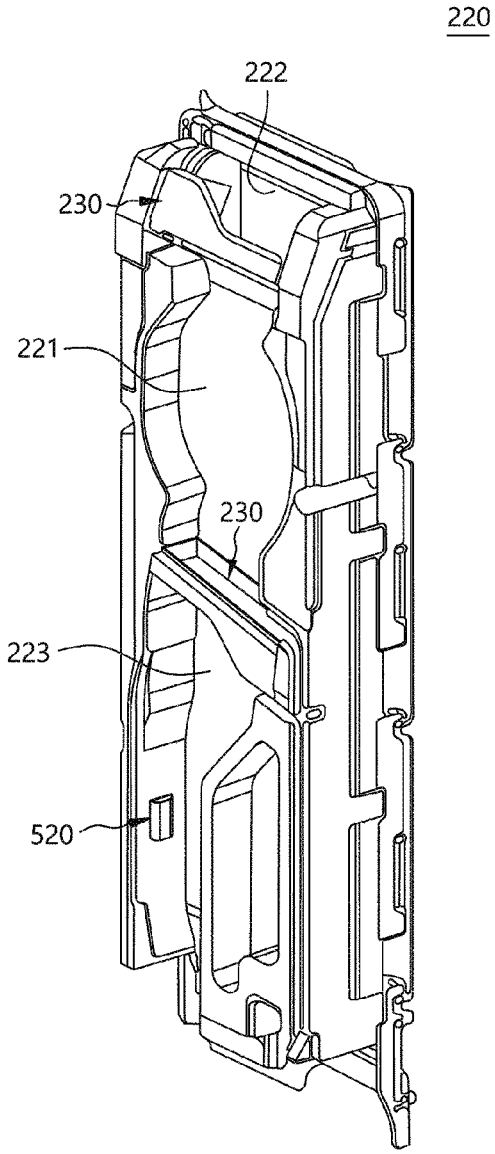

[FIG. 21]
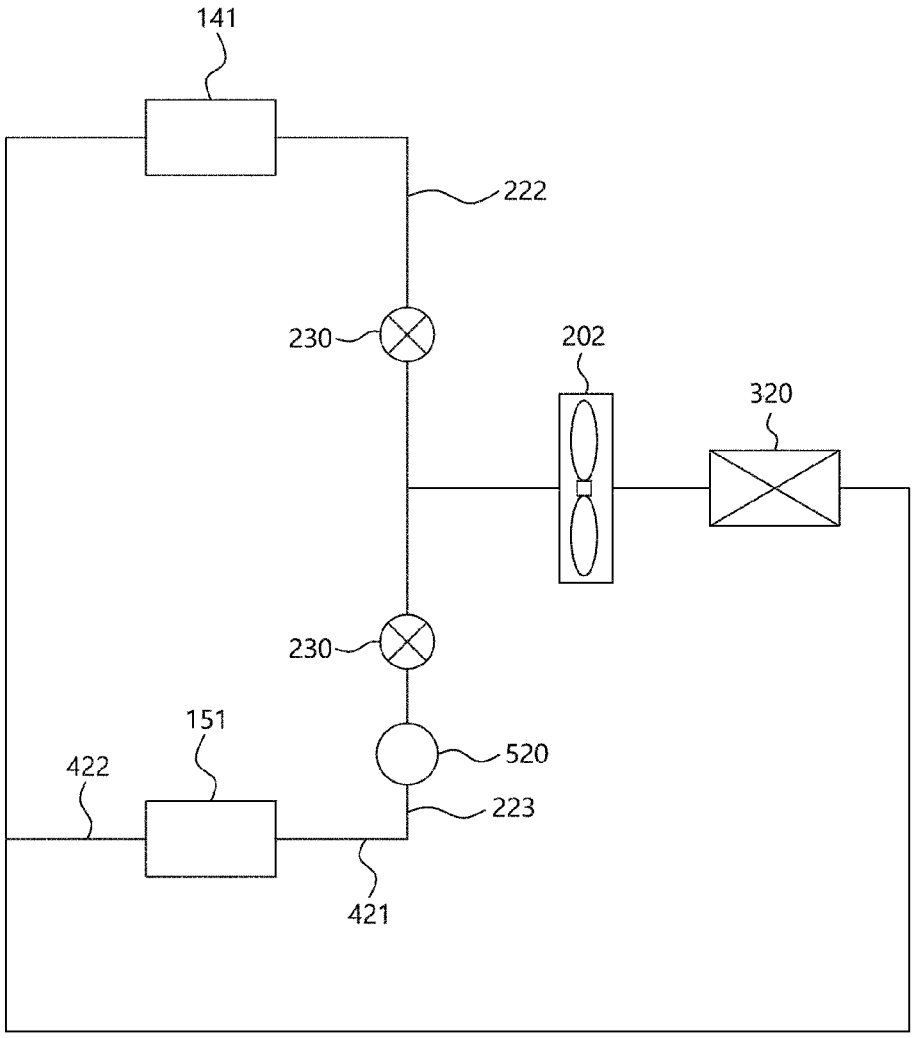

[FIG. 22]
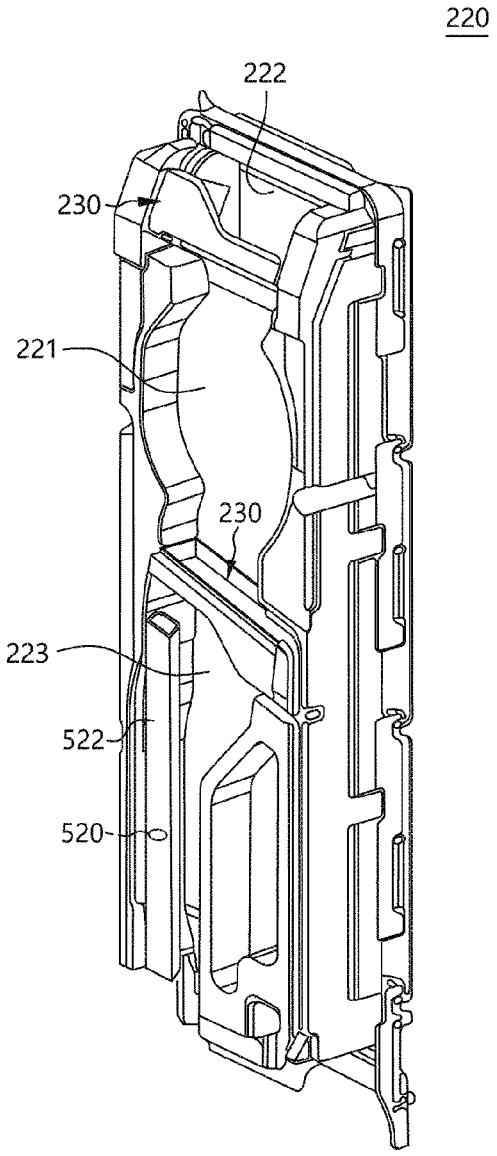

[FIG. 23]
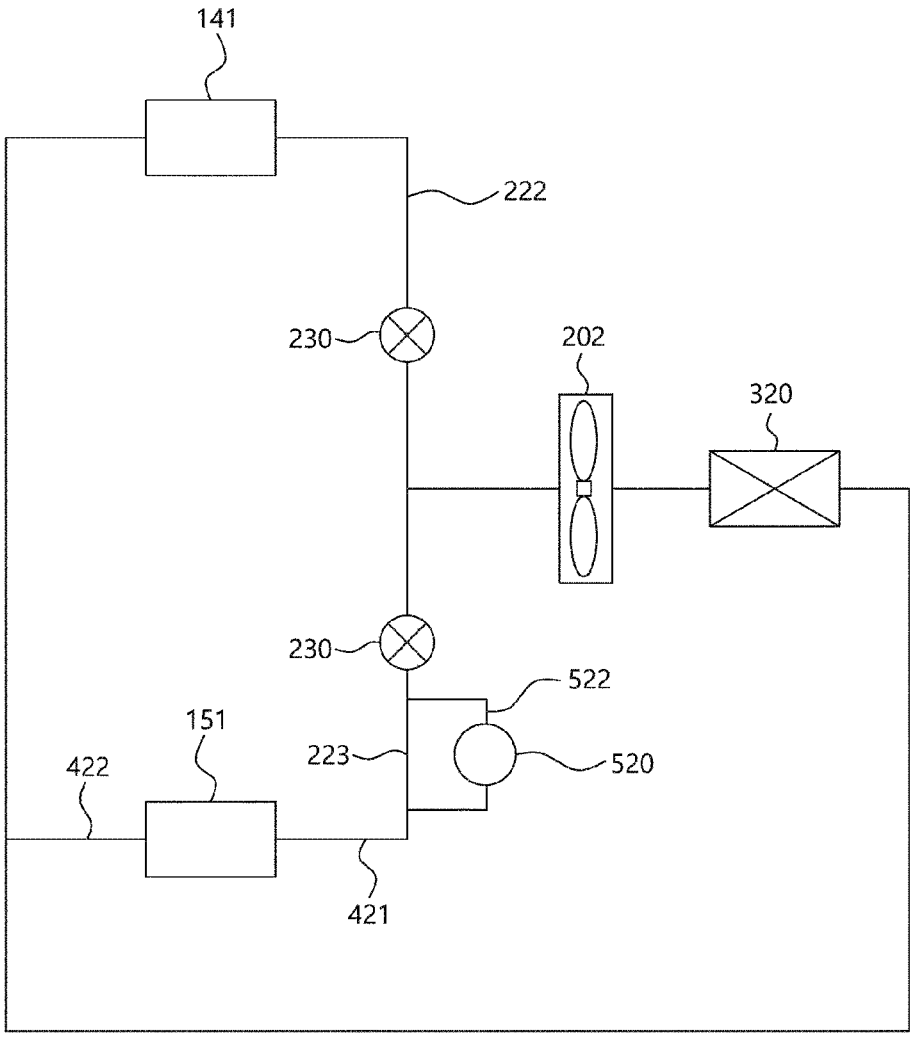

[FIG. 24]
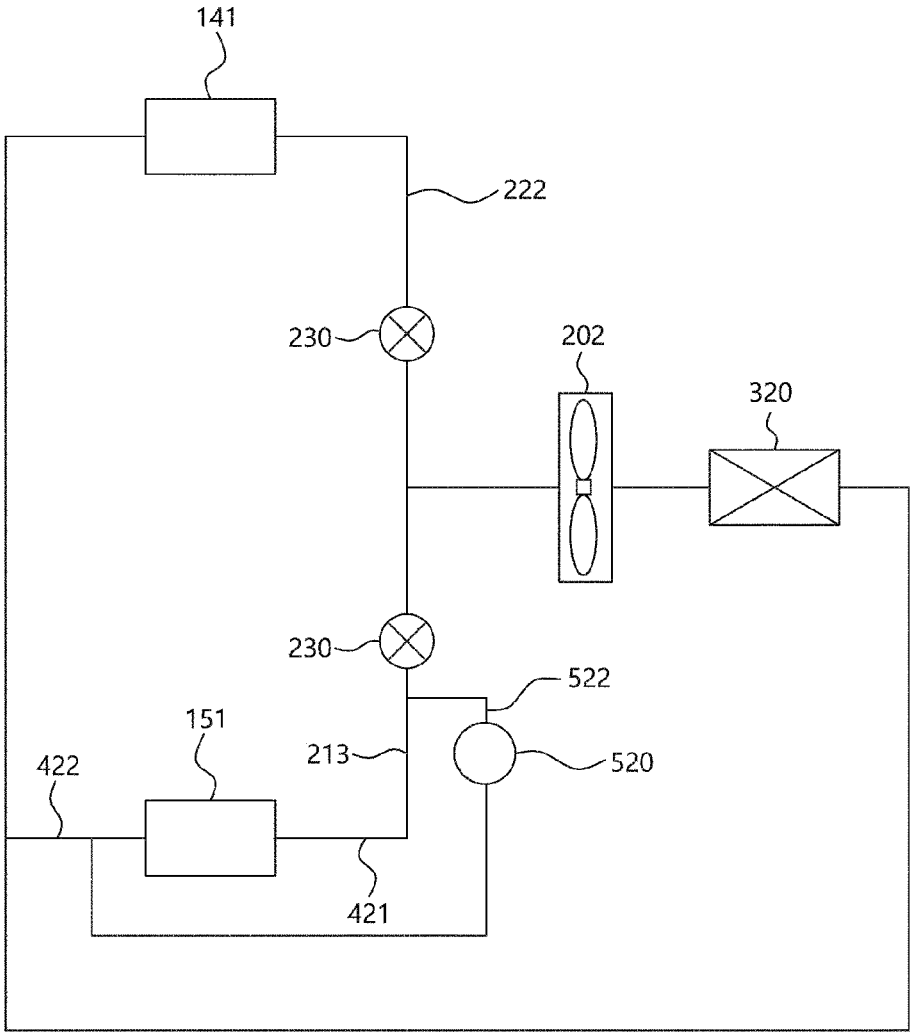

[FIG. 25]
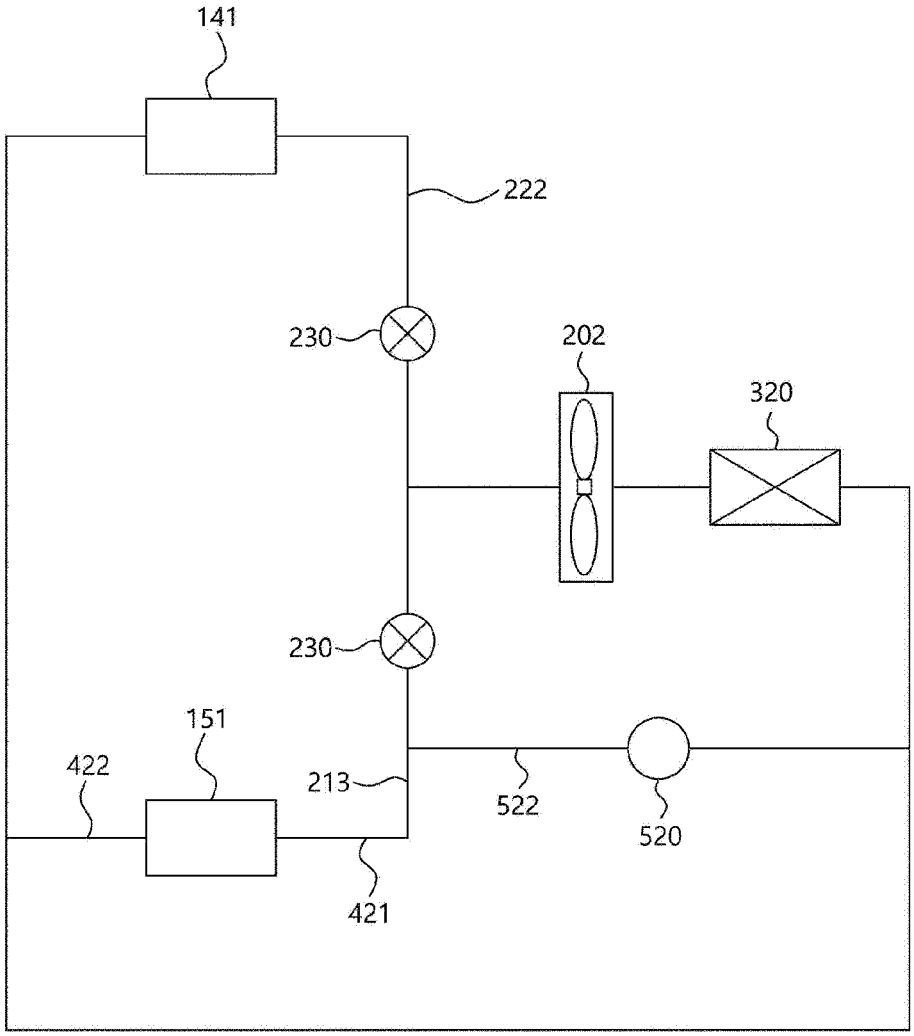

[FIG. 26]
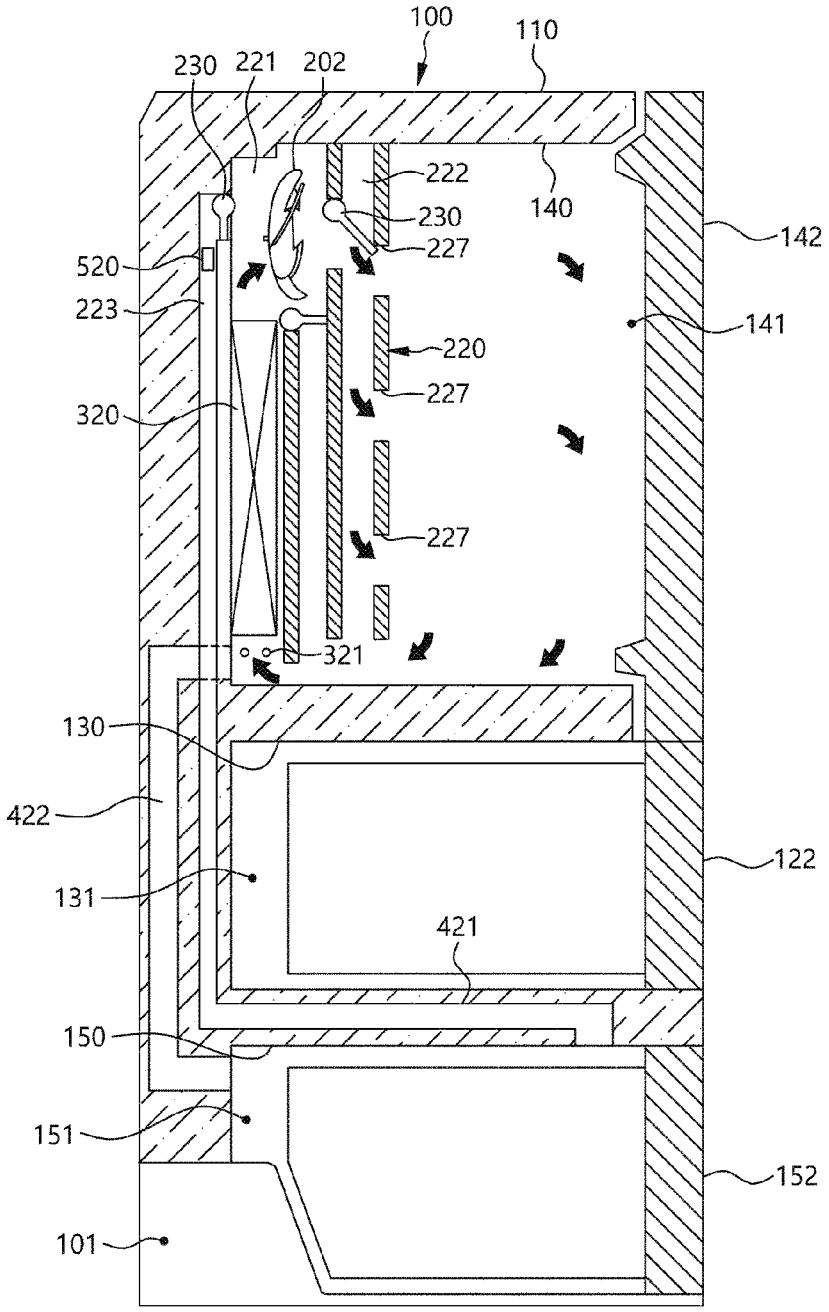

[FIG. 27]
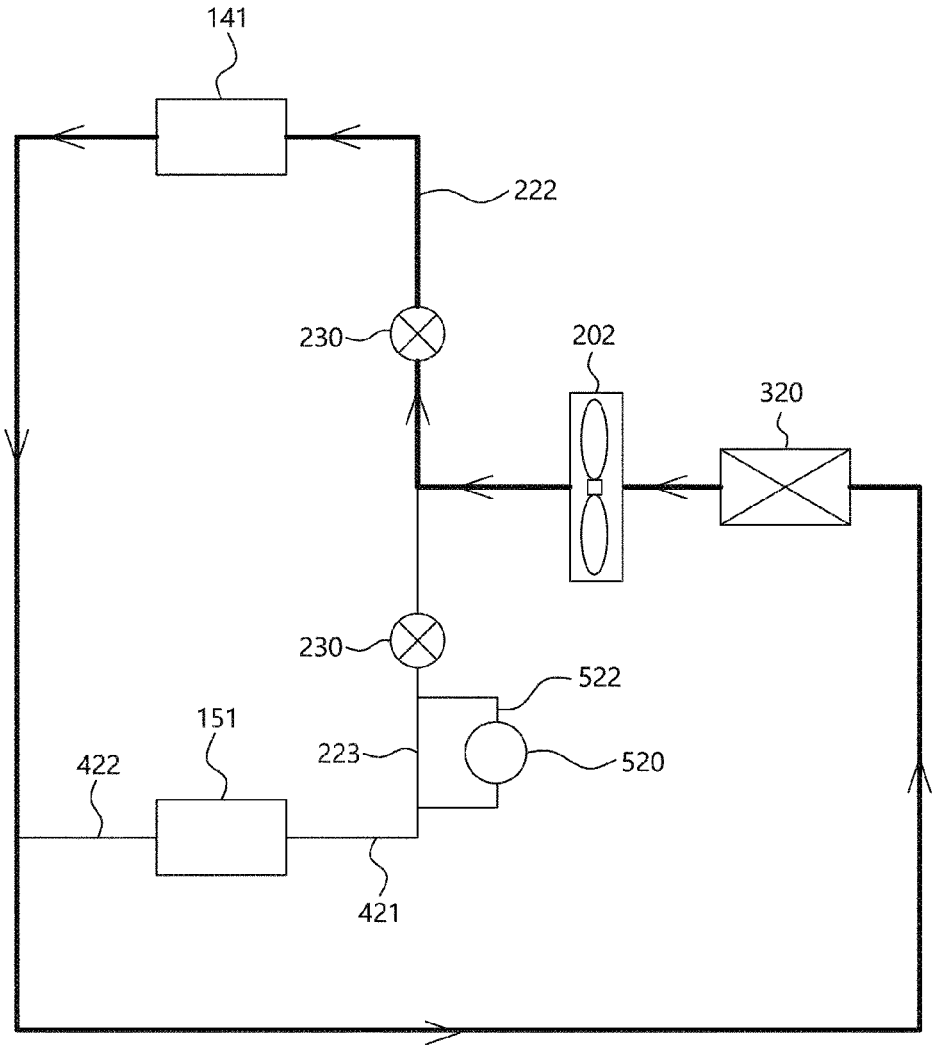

[FIG. 28]
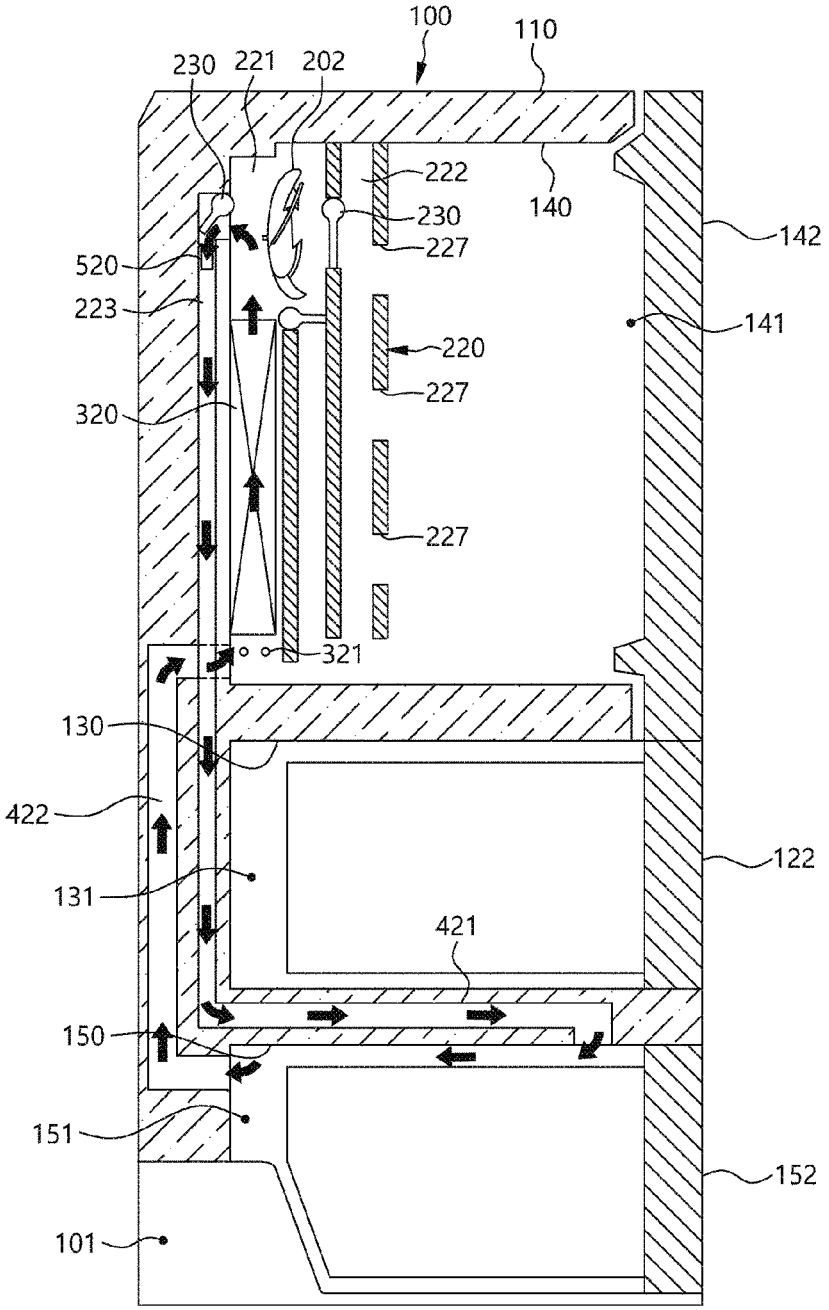

[FIG. 29]
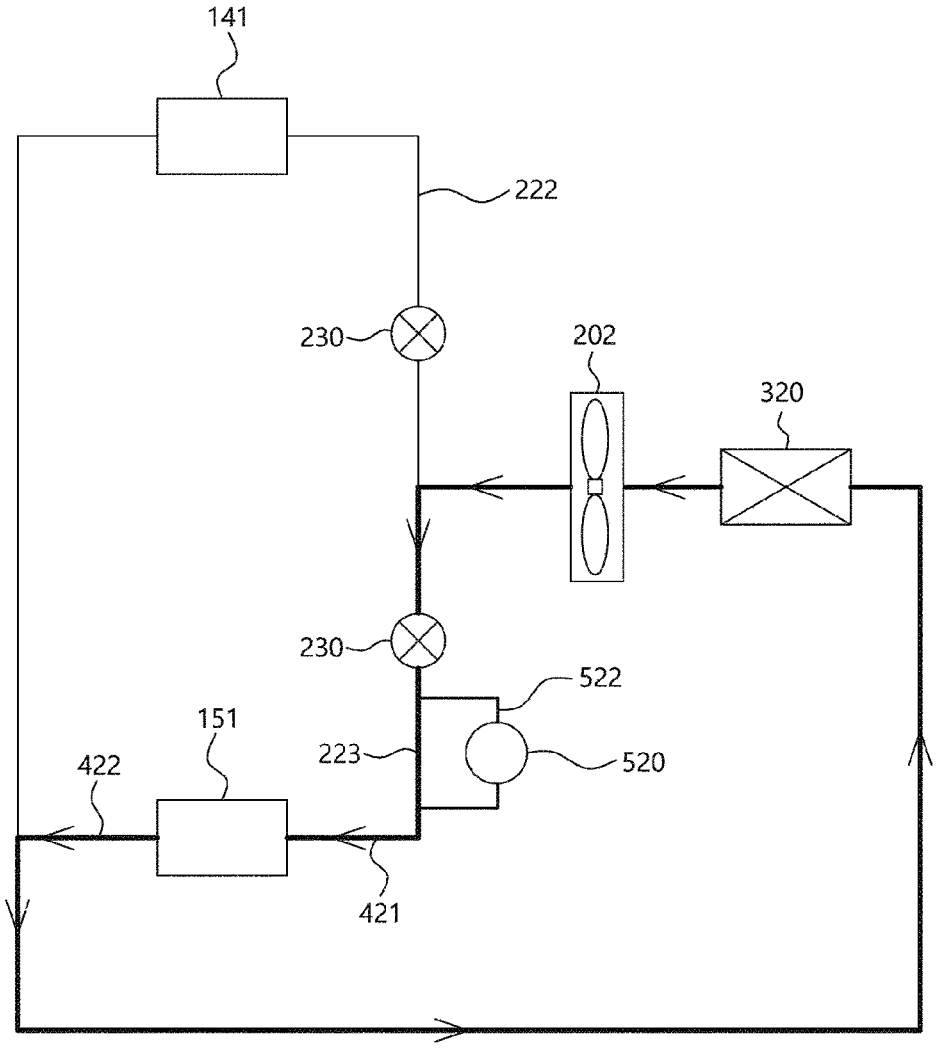

[FIG. 30]
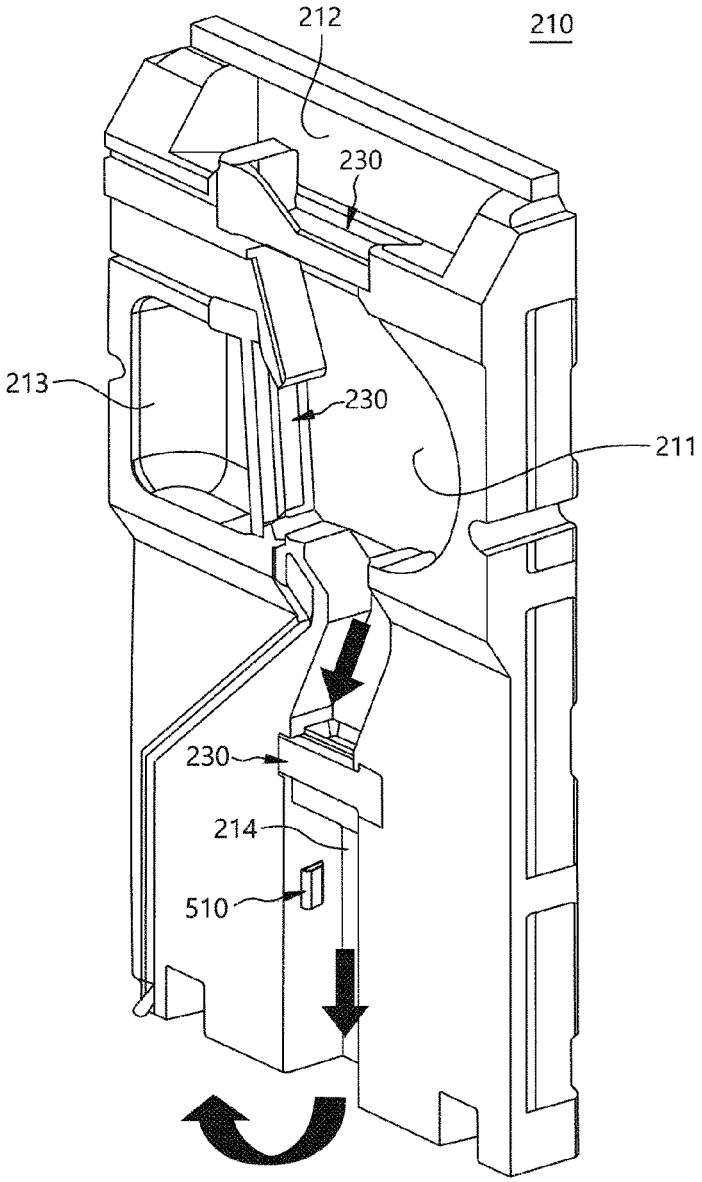

[FIG. 31]
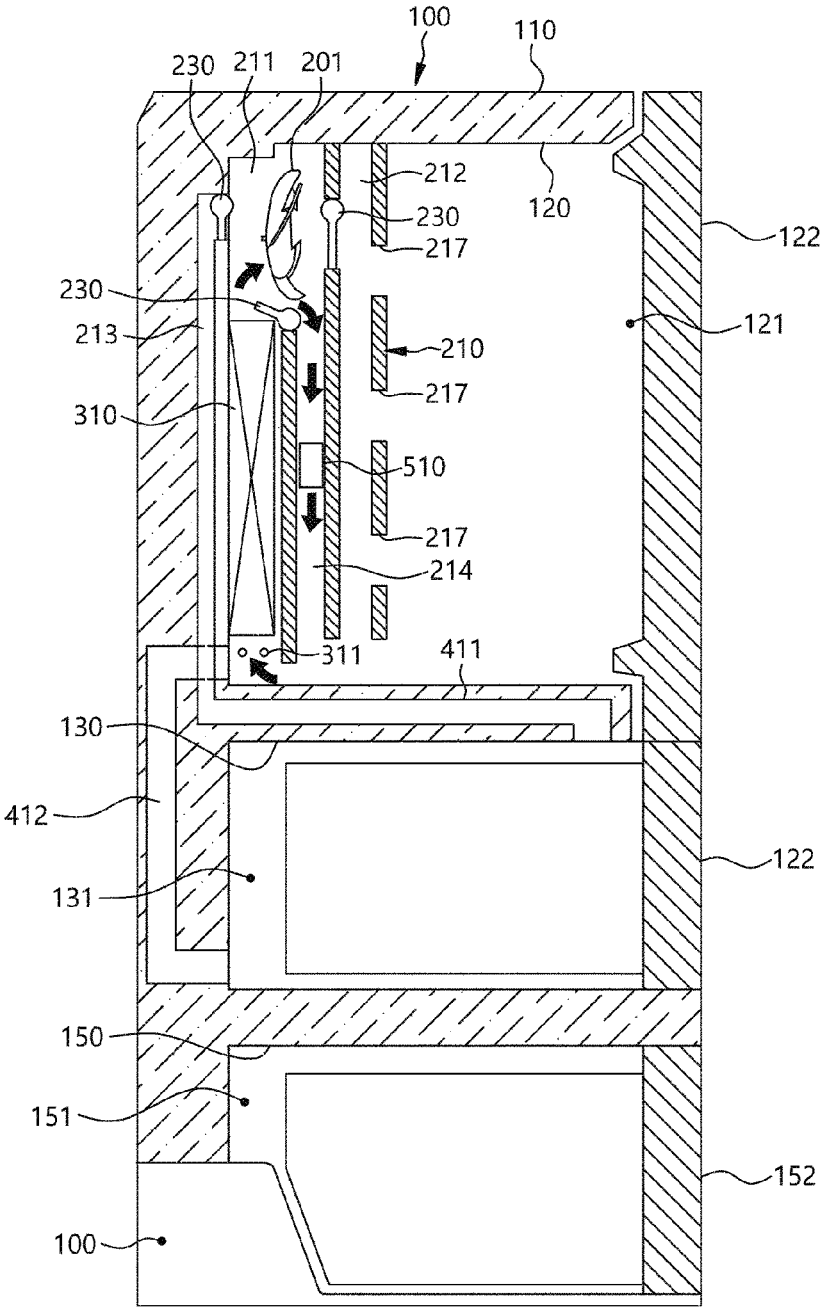

[FIG. 32]
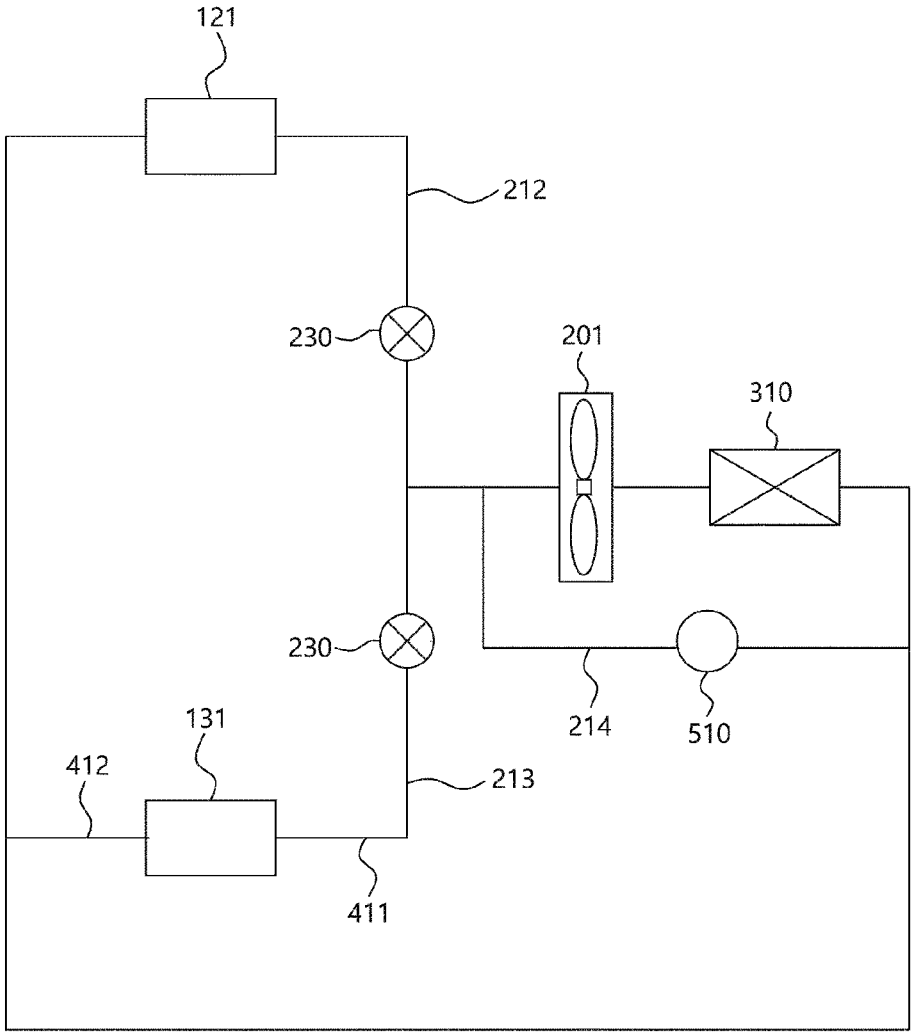

[FIG. 33]
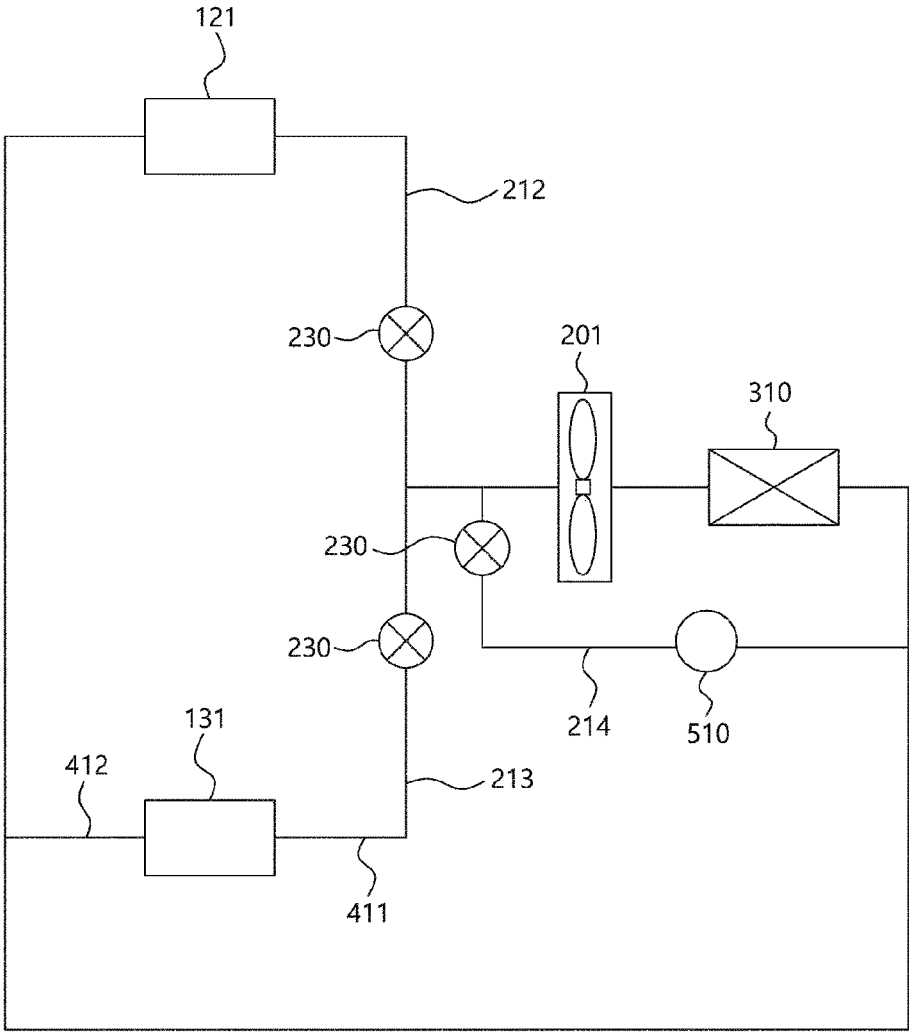

[FIG. 34]
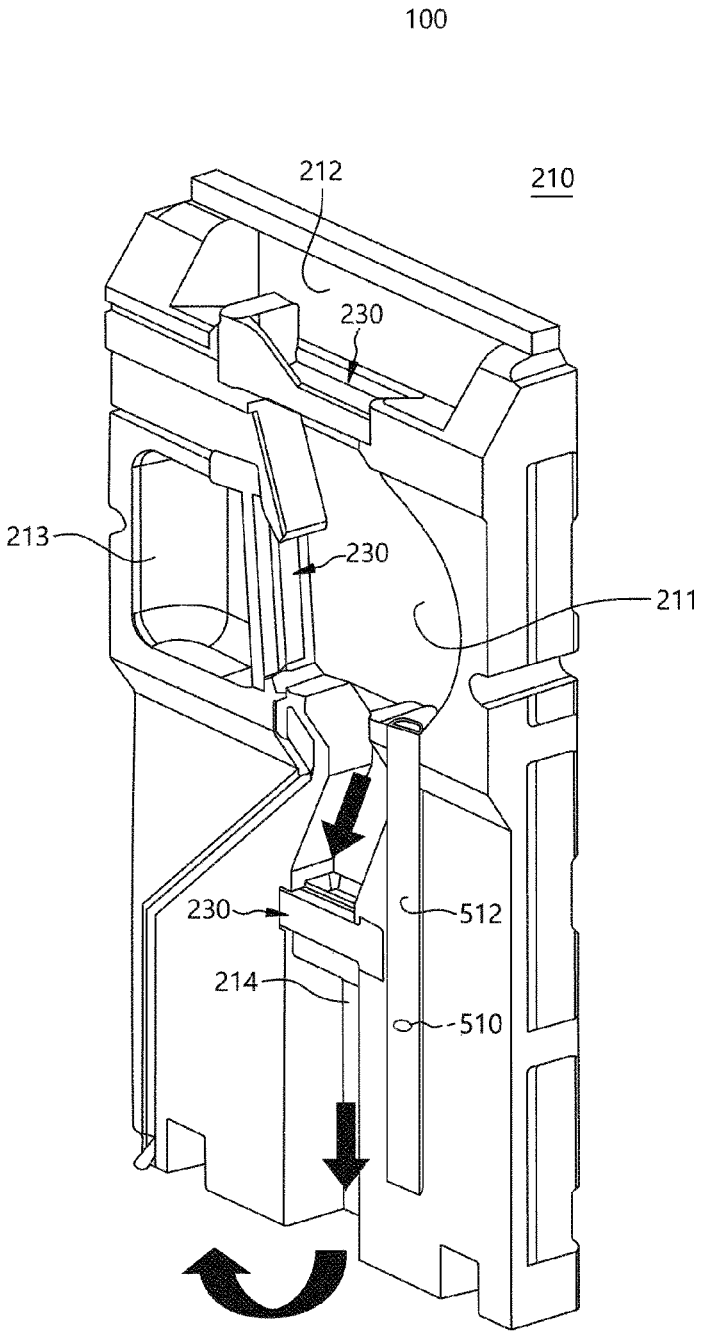

[FIG. 35]
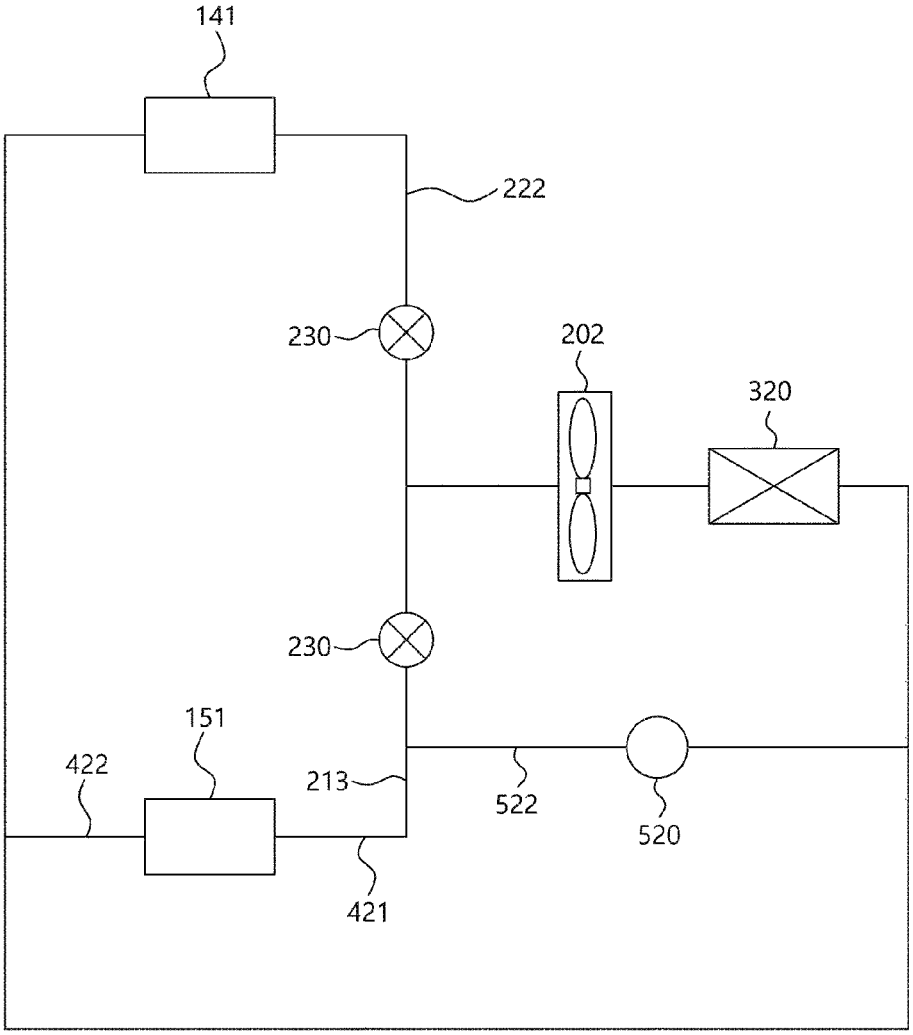

[FIG. 36]
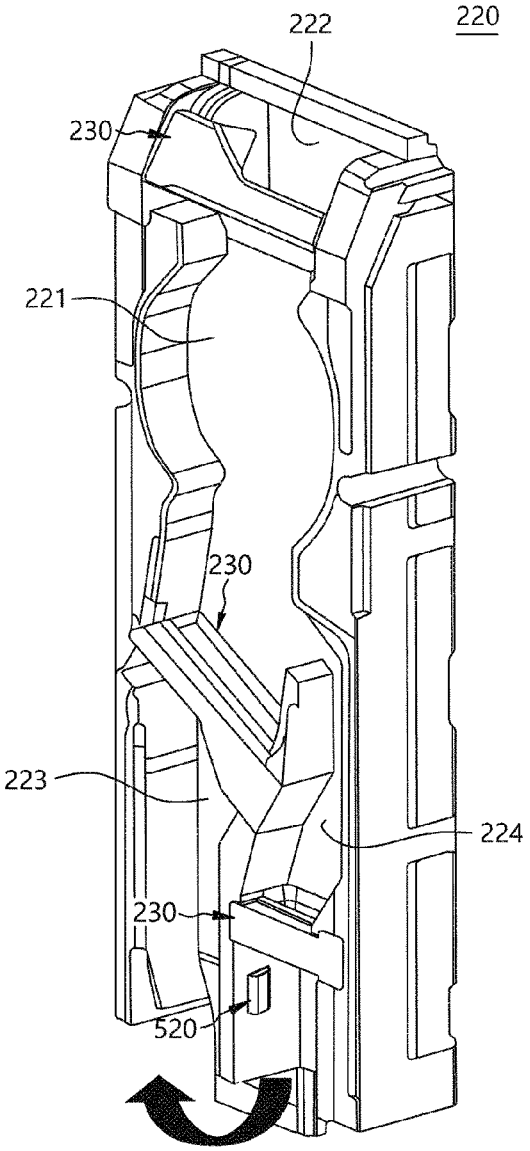

[FIG. 37]
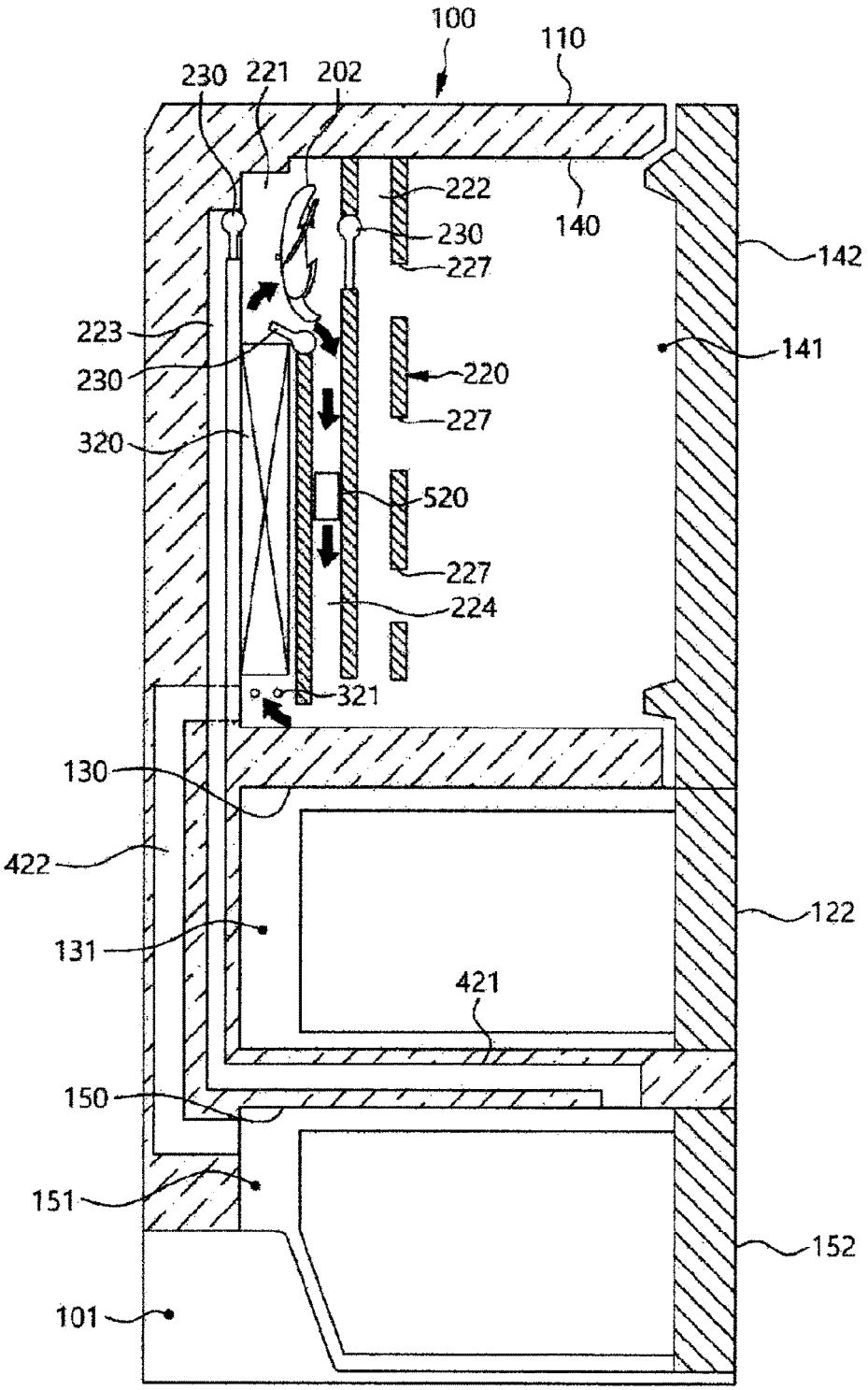

[FIG. 38]
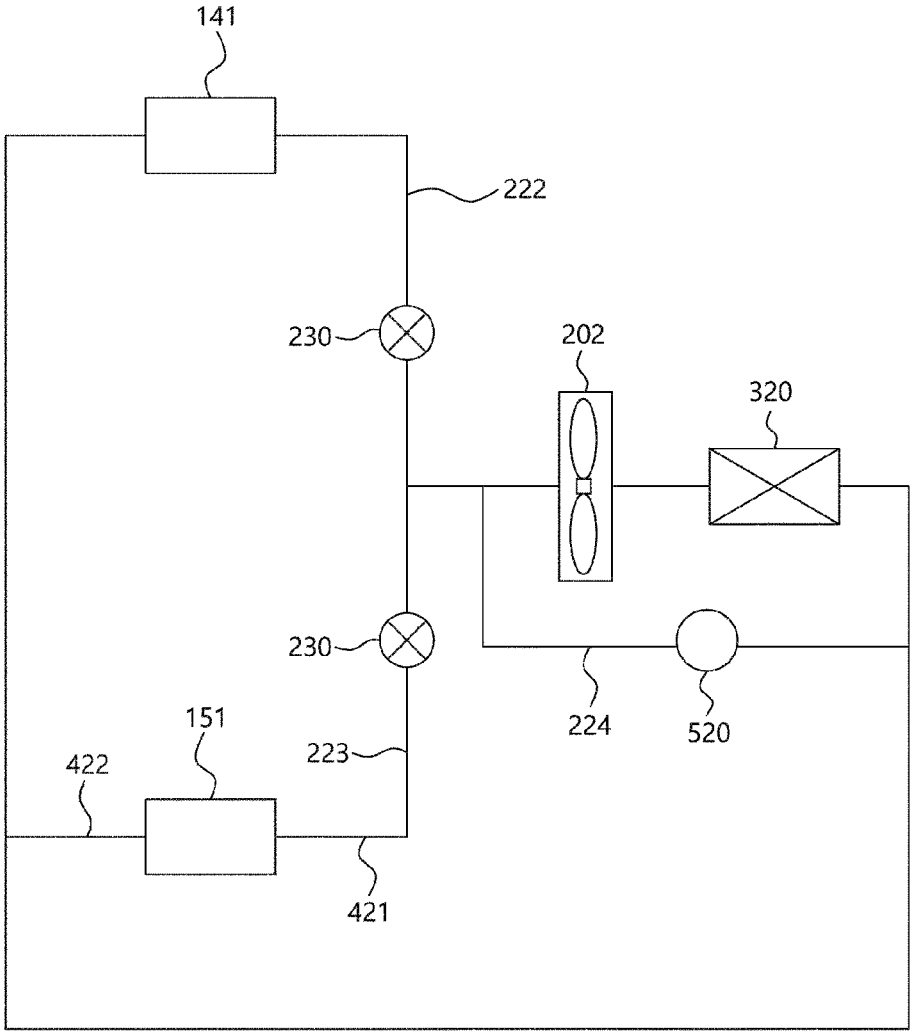

[FIG. 39]
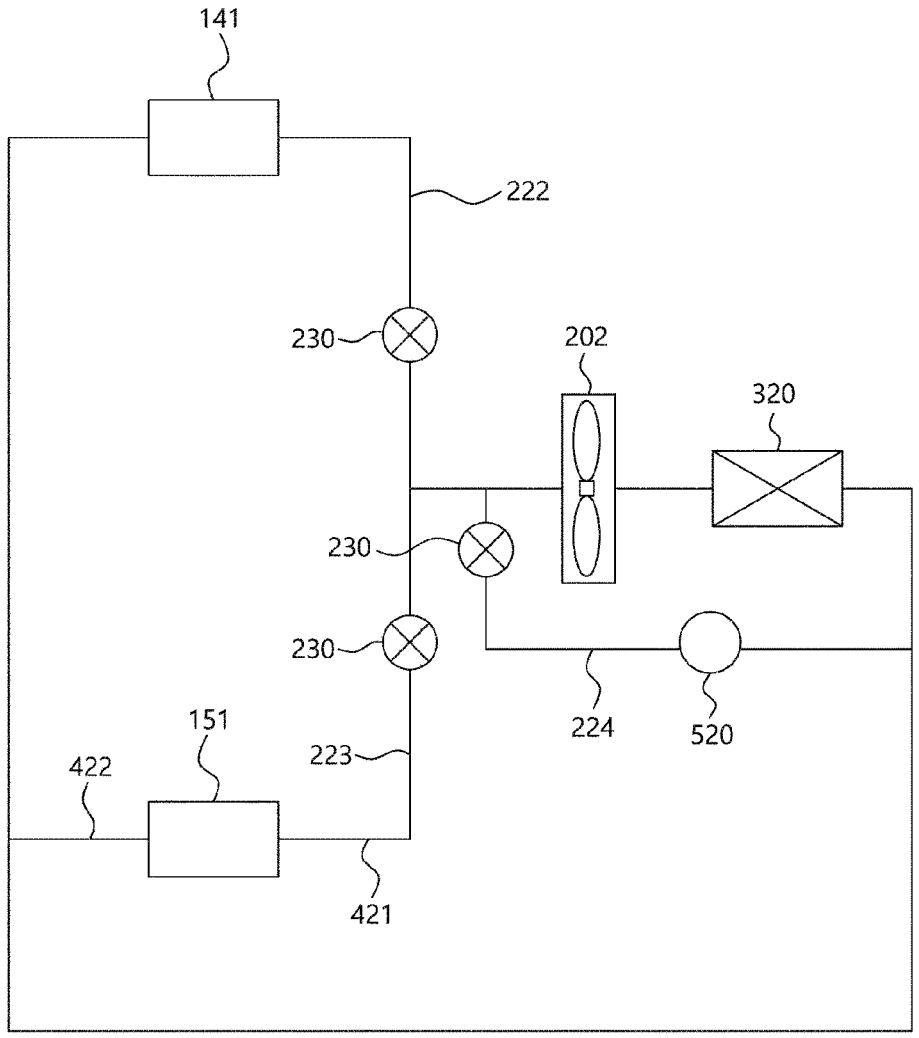

[FIG. 40]
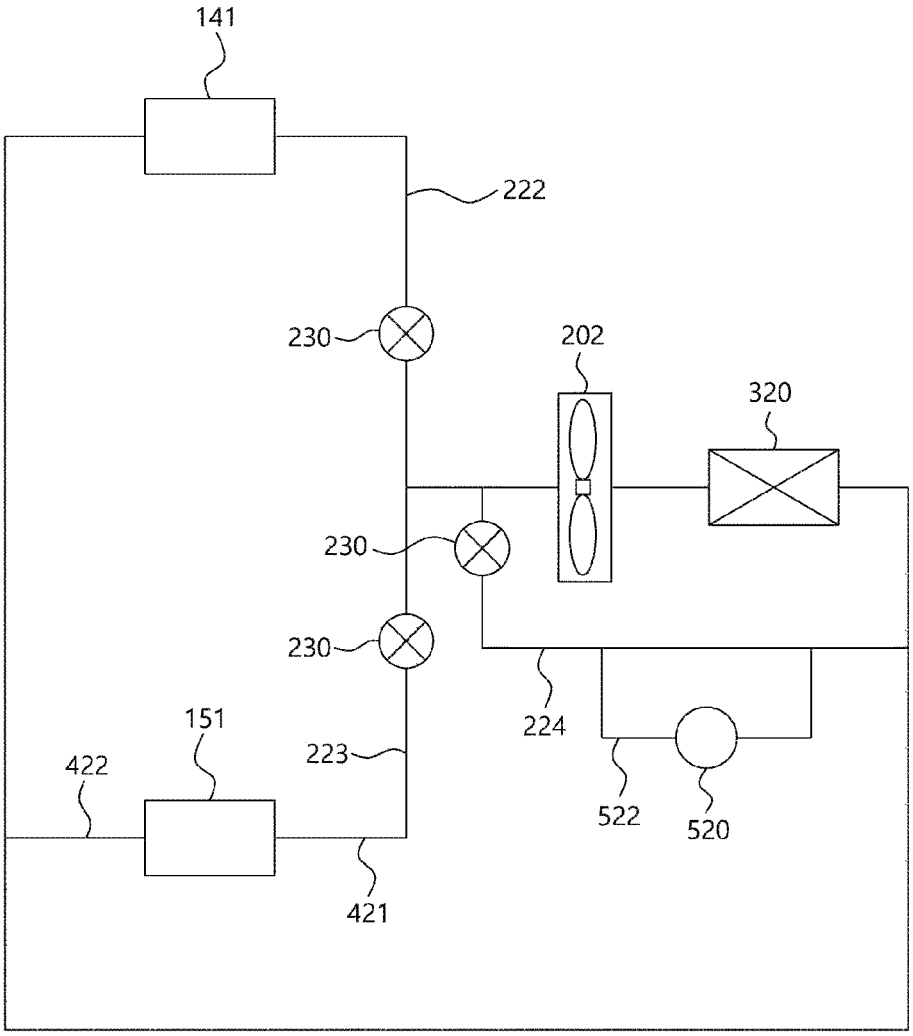

REFRIGERATOR INCLUDING A DETECTION SENSOR AT AN AIR DISCHARGE SIDE OF A BLOWING FAN

CROSS REFERENCE TO RELATED APPLICATION

This application is a National Stage Application under 35 U.S.C. § 371 of International Application No. PCT/KR2022/007310, filed on May 23, 2022, which claims the benefit if earlier filing date and right of priority to Korean Patent Application No. 10-2021-0082390, filed on Jun. 24, 2021, the entire contents of which is incorporated herein for all purposes by this reference.

TECHNICAL FIELD

The present disclosure relates to a refrigerator of a new type capable of accurately detecting defrosting of a cooling source of a refrigerator having a plurality of storage compartments.

BACKGROUND ART

Generally, a refrigerator is a device capable of storing a storage objects stored in a storage space by using cold air for a long time or while maintaining a constant temperature.

The refrigerator includes a refrigeration system including one or more evaporators to generate and circulate the cold air.

Here, the evaporator performs a heat exchange function between a low-temperature, low-pressure refrigerant and the refrigerator's internal air (cold air circulating in the inside the refrigerator) to maintain the internal air within a set temperature range.

While the evaporator exchanges heat with the internal air, frost occurs on its surface due to water or humidity contained in the internal air or moisture existing around the evaporator.

Conventionally, a defrosting operation is performed to remove frost formed on the surface of the evaporator after a certain time has elapsed since the refrigerator was started.

That is, conventionally, the defrosting operation is performed through indirect estimation based on an operation time, rather than directly detecting the frosting amount formed on the surface of the evaporator.

Accordingly, conventionally, there are problems in that consumption efficiency is lowered due to the defrosting operation being performed even though frost is not formed or that the defrosting operation is not performed despite excessive frosting.

Recently, a method of using a temperature difference or a pressure difference between an inlet side and an outlet side of the evaporator has been proposed in order to accurately detect the frosting amount on the surface of the evaporator. In this regard, the method is disclosed in Korean Patent Publication No. 10-2019-0101669, Korean Patent Publication No. 10-2019-01006201, Korean Patent Publication No. 10-2019-01006242, Korean Patent Publication No. 10-2019-0112482, Korean Patent Publication No. 10-2019-0112464, and the like.

That is, according to recent prior art, a bypass flow path configured to have a flow separate from an air flow passing through the evaporator is formed in a cold air duct, and a temperature difference changed according to a difference in the amount of air passing through the bypass flow path is measured to accurately determine a start time of defrosting operation.

However, in the prior art described above, since an inlet of the bypass flow path is positioned on a side where air flows into the evaporator, it is difficult to accurately detect the frost of the evaporator when air does not flow smoothly.

That is, since the frost is detected by the air volume considering the temperature difference of each position of the air flowing from the bottom of the evaporator to the upper side of the evaporator, it is difficult to accurately detect the frost when the air flow is small.

In the prior art, the defrosting operation end time of the evaporator is controlled to be determined based on the operation time, so that accurate defrosting detection is not performed.

For example, even if defrosting is completed earlier than a set time, conventionally a heat supply unit continuously generates heat for the set time to perform the defrosting operation, power consumption is not reduced due to unnecessary heat generation of the heat supply unit.

In addition, even if the set time is reached, when the defrosting is not completely performed, the performance of the heat exchange of the evaporator is inevitably degraded by the remaining frost or ice.

Along with this, as the temperature raised by the unnecessary heat generation of the heat supply unit needs to be cooled down after the end of the defrosting operation, power consumption is increased.

In addition, in the prior art described above, a bypass flow path is formed in the grille assembly. When a structural change to the flow path is required, there is a manufacturing difficulty in that the mold for manufacturing the grille assembly needs to be changed.

DISCLOSURE

Technical Problem

An object of the present disclosure is to accurately detect frost formation of a cooling source by inducing sufficient air flow by allowing a detection sensor for detecting frosting or defrosting to be located on an air discharge side of a blowing fan.

Another object of the present disclosure is to accurately detect frost formation of the cooling source by allowing the detection sensor to be located in a portion where air flows from top to bottom.

Another object of the present disclosure is to determine the defrosting end time of the cooling source as the temperature of the air introduced into the cooling source, not as the operation time, thereby more accurately detecting defrosting.

Technical Solution

In the refrigerator according to the present discloser, a grille assembly may include a detection sensor disposed on an air discharge side of a blowing fan.

In the refrigerator according to the present discloser, the detection sensor may be configured as a sensor for determining a degree of frost formation or defrosting of a cooling source.

In the refrigerator according to the present discloser, the detection sensor may be configured to detect a temperature change according to a change in flow rate of air flowing through the blowing fan.

In the refrigerator according to the present discloser, a second guide flow path may be formed to allow air to flow to a side of an installation part.

In the refrigerator according to the present discloser, the detection sensor may be installed on at least one wall of the second guide flow path.

In the refrigerator according to the present discloser, the second guide flow path may be formed such that air flows to a lower side of the installation part and then is provided to a second storage compartment.

In the refrigerator according to the present discloser, the detection sensor may be installed on an air outlet side of a damper assembly.

In the refrigerator according to the present discloser, the detection sensor may be disposed in a sensing duct.

In the refrigerator according to the present discloser, the sensing duct may be formed to have a flow path partitioned from the inside of the second guide flow path.

In the refrigerator according to the present discloser, an air inlet side of the sensing duct may be opened so that air flowing along the second guide flow path is introduced.

In the refrigerator according to the present discloser, the air inlet side of the sensing duct may be opened toward an upper portion of the second guide flow path.

In the refrigerator according to the present discloser, the air inlet side of the sensing duct may be installed on an air outlet side of the damper assembly.

In the refrigerator according to the present discloser, the air inlet side of the sensing duct may be opened to an inside of the installation part.

In the refrigerator according to the present discloser, an air outlet side of the sensing duct may be opened toward an air inlet side of the cooling source.

In the refrigerator according to the present discloser, the air outlet side of the sensing duct may be opened into the second guide flow path.

In the refrigerator according to the present discloser, the air outlet side of the sensing duct may be opened toward a lower portion of the second guide flow path.

In the refrigerator according to the present discloser, the grille assembly may include a third guide flow path for guiding air to flow from the installation part to the air inlet side of the cooling source.

In the refrigerator according to the present discloser, the detection sensor may be installed on at least one wall of the third guide flow path.

In the refrigerator according to the present discloser, the third guide flow path may be provided with a third damper for opening and closing the third guide flow path.

In the refrigerator according to the present discloser, the detection sensor may be installed on an air outlet side of the third damper.

In the refrigerator according to the present discloser, the sensing duct having the detection sensor may be formed to have a flow path partitioned from the third guide flow path.

Advantageous Effects

As described above, the refrigerator of the present disclosure has at least one of the following effects.

According to the refrigerator of the present disclosure, since a detection sensor for detecting frosting or defrosting is located on an air discharge side of a blowing fan for air blowing, sufficient air may flow through the detection sensor, thereby accurately detecting frost formation of a cooling source.

According to the refrigerator of the present disclosure, since the detection sensor is located at a portion where air flows from top to bottom, even if the amount of air blowing is small, it is possible to accurately detect the frost formation of the cooling source.

According refrigerator of the present disclosure, since the defrosting end time of the cooling source is determined by the temperature of the air flowing into the cooling source, the defrosting end time may be accurately determined.

According to the refrigerator of the present disclosure, since the detection sensor is located in a sensing duct, it is possible to accurately determine whether the cooling source is frosted even with a small amount of air.

According to the refrigerator of the present disclosure, since the sensing duct is formed such that both ends thereof are opened in an installation part of a grille assembly and an air inlet side of the cooling source, it is possible to accurately determine whether the cooling source is frosted, even if a guide flow path is closed due to a closing operation of each damper.

According to the refrigerator of the present disclosure, a third guide flow path is provided to be bypassed directly to the air inlet side of the cooling source separately from a flow path for cooling, and the third guide flow path is opened and closed by a third damper. The detection sensor is provided in the third guide flow path, making it possible to detect frosting and defrosting of the cooling source.

According to the refrigerator of the present disclosure, since air is repeatedly supplied to the cooling source when a defrosting operation is performed, defrosting of the cooling source may be performed more quickly, thereby reducing power consumption.

DESCRIPTION OF DRAWINGS

FIG. 1 is a perspective view showing an exterior structure of a refrigerator according to an embodiment of the present disclosure.

FIG. 2 is a front view showing an internal structure of the refrigerator according to an embodiment of the present disclosure.

FIG. 3 is a perspective view showing an air flow between a first inner casing and a second inner casing in the refrigerator according to an embodiment of the present disclosure.

FIG. 4 is a schematic cross-sectional view showing an air flow between the first inner casing and the second inner casing in the refrigerator according to an embodiment of the present disclosure.

FIG. 5 is a perspective view of a first grille assembly according to an embodiment of the present disclosure.

FIG. 6 is a block diagram showing an air flow between the first inner casing and the second inner casing in the refrigerator according to an embodiment of the present disclosure.

FIG. 7 is a perspective view showing an example of a damper of the refrigerator according to an embodiment of the present disclosure.

FIG. 8 is a perspective view showing an example of a detection sensor of the refrigerator according to an embodiment of the present disclosure.

FIG. 9 is a perspective view showing an example of a state in which the detection sensor is installed in a sensing duct in the refrigerator according to an embodiment of the present disclosure.

FIG. 10 is a perspective view showing an example of a state in which the sensing duct is installed in the first grille assembly of the refrigerator according to an embodiment of the present disclosure.

FIGS. 11 to 13 are block diagrams showing an example of a state in which the sensing duct is installed in the first grille assembly of the refrigerator according to an embodiment of the present disclosure.

FIGS. 14 and 15 are state diagrams showing a cooling operation process for the first storage compartment of the refrigerator according to an embodiment of the present disclosure.

FIGS. 16 and 17 are state diagrams showing the cooling operation process for the second storage compartment of the refrigerator according to an embodiment of the present disclosure.

FIG. 18 is a perspective view showing an air flow between a third inner casing and a fourth inner casing in the refrigerator according to an embodiment of the present disclosure.

FIG. 19 is a schematic cross-sectional view showing the air flow between the third inner casing and the fourth inner casing in the refrigerator according to an embodiment of the present disclosure.

FIG. 20 is a perspective view of a second grille assembly according to an embodiment of the present disclosure.

FIG. 21 is a block diagram showing an air flow between a third storage compartment and a fourth storage compartment in the refrigerator according to an embodiment of the present disclosure.

FIG. 22 is a perspective view showing an example of a state in which a sensing duct is installed in the second grille assembly of the refrigerator according to an embodiment of the present disclosure.

FIG. 23 is a block diagram showing an example of a state in which the sensing duct is installed in the second grille assembly of the refrigerator according to an embodiment of the present disclosure.

FIGS. 24 and 25 are block diagrams showing each example of an air outlet position of the sensing duct in the second grille assembly of the refrigerator according to an embodiment of the present disclosure.

FIGS. 26 and 27 are state diagrams showing the cooling operation process for the third storage compartment of the refrigerator according to an embodiment of the present disclosure.

FIGS. 28 and 29 are state diagrams showing the cooling operation process for the fourth storage compartment of the refrigerator according to an embodiment of the present disclosure.

FIG. 30 is a perspective view of a state in which a third guide flow path and a detection sensor are provided in the first grille assembly of the refrigerator according to an embodiment of the present disclosure.

FIG. 31 is a schematic cross-sectional view showing a state in which the third guide flow path and the detection sensor are provided in the first grille assembly of the refrigerator according to an embodiment of the present disclosure.

FIGS. 32 and 33 are block diagrams showing an example of a state in which the detection sensor is installed in the third guide flow path formed in the first grille assembly of the refrigerator according to an embodiment f the present disclosure.

FIG. 34 is a perspective view showing a state in which the sensing duct provided in the first grille assembly is installed separately from the third guide flow path in the refrigerator according to an embodiment of the present disclosure.

FIG. 35 is a block diagram showing a state in which the sensing duct provided in the first grille assembly is installed separately from the third guide flow path in the refrigerator according to an embodiment of the present disclosure.

FIG. 36 is a perspective view of a state in which the detection sensor is installed in the third guide flow path formed in the second grille assembly of the refrigerator according to an embodiment of the present disclosure.

FIG. 37 is a schematic cross-sectional view of a state in which the detection sensor is installed in the third guide flow path formed in the second grille assembly of the refrigerator according embodiment of the present disclosure.

FIGS. 38 and 39 are block diagrams respectively showing an example of a state in which the detection sensor is installed in the third guide flow path formed in the second grille assembly of the refrigerator according to an embodiment of the present disclosure.

FIG. 40 is a block diagram of a state in which the sensing duct provided in the second grille assembly is installed separately from the third guide flow path of the refrigerator according to an embodiment of the present disclosure.

BEST MODE

Hereinafter, a preferred embodiment of a refrigerator of the present disclosure will be described with reference to accompanying FIGS. 1 to 40.

Prior to the description of the embodiment, a structure related to the refrigerator of the present disclosure takes a structure applied to a kimchi refrigerator as an example.

FIG. 1 shows an exterior of a refrigerator according to an embodiment of the present disclosure, and FIG. 2 is a front view showing an internal structure of the refrigerator according to the embodiment of the present disclosure.

As shown in these drawings, the refrigerator according to the embodiment of the present disclosure includes a casing 100 having a storage compartment.

The casing 100 may include an outer casing 110 defining an exterior shape of the refrigerator and inner casings 120, 130 providing storage compartments 121 and 131.

A plurality of inner casings 120, 130 may be provided.

For example, as shown in FIGS. 2 to 4, the inner casings 120, 130 include a first inner case 120 defining a first storage compartment 121.

The first storage compartment 121 may be a front space of a first grille assembly 210 in the first inner casing 120. Various storage items may be stored in the first storage compartment 121.

The inner casings 120, 130 may further include a second inner casing 130 defining a second storage compartment 131, and the second inner casing 130 may be disposed on one side of the first inner casing 120. For example, the second inner casing 130 may be disposed below the first inner casing 120.

Meanwhile, each of the inner casings may be opened or closed by doors 122, 132, respectively. At this time, the doors 122, 132 may be a rotary door or a drawer-type door.

For example, a rotary door 122 may be provided in the first inner casing 120 on the upper side to open and close the first storage compartment 121. A drawer-type door 132 may be provided in the second inner casing 130 on the lower side to open and close the second storage compartment 131.

Although not shown, the inner casing may further include an inner casing separate from the first inner casing or the second inner casing. That is, three or more storage compartments may be provided.

Next, the refrigerator according to the embodiment of the present disclosure may include a first grille assembly 210.

The first grille assembly 210 guides air blown by a first blowing fan 201.

The first grille assembly 210 may be installed in the first inner casing 120.

More specifically, as shown in FIG. 4, the first grille assembly 210 may be installed in a rear space in the first inner casing 120.

The first storage compartment 121 may be a front space of the first grille assembly 210 inside the first inner casing 120, and a first cooling source 310 may be disposed in a rear space of the first grille assembly 210. That is, the first grille assembly 210 partitions the space where the first cooling source 310 is installed from the first storage compartment 121.

As shown in FIG. 5, an installation part 211 may be formed in the first grille assembly 210.

The installation part 211 may be recessed forward to accommodate at least a portion of the first blowing fan 201.

A first guide flow path 212 may be formed in the first grille assembly 210.

The first guide flow path 212 may guide air to flow from the installation part 211 to the first storage compartment 121. The first guide flow path 212 may extend upward of the installation part 211. A lower end of the first guide flow path 212 may communicate with an inner space of the installation part 211.

As shown in FIGS. 4 to 6, a second guide flow path 213 may be formed in the first grille assembly 210.

The second guide flow path 213 may guide air to flow from the installation part 211 to the second storage compartment 131. The second guide flow path 213 guides the air to be supplied to the second storage compartment 131 after flowing to a side of the installation part 211.

One end of a first guide duct 411 may be connected to the second guide flow path 213, and the other end of the first guide duct 411 may be connected to the second storage compartment 131 of the second inner casing 130. Thus, the air flowing along the second guide flow path 213 is guided to be provided to the second storage compartment 131 by the first guide duct 411.

The other end of the first guide duct 411 may be connected to a front side of the upper surface of the second inner casing 130.

The air flowing in the second storage compartment 131 of the second inner casing 130 is recovered to an air inlet side of the first cooling source 310 disposed in the first inner casing 120, through a first recovery duct 412.

A damper assembly 230 may be provided in the first guide flow path 212. That is, air may selectively pass through the first guide flow path 212 by the damper assembly 230.

In FIG. 7, an example of the damper assembly 230 is illustrated. The damper assembly 230 may include a housing 231 having a through hole 231*a*. The damper assembly 230 may include a gate 232 for opening/closing the through hole 231*a* of the housing 231, and a motor 233 for selectively rotating the gate 232.

Another damper assembly 230 may be provided in the second guide flow path 213. That is, the second guide flow path 213 may be selectively opened and closed by the damper assembly 230.

Although not shown, only the shape or size of the housing 231 of the damper assembly 230 may be changed according to an installation position.

The damper assembly 230 provided in the second guide flow path 213 may be disposed adjacent to a boundary between the second guide flow path 213 and the installation part 211 or adjacent to the installation part 211 of the second guide flow path 213. That is, the damper assembly 230 is positioned as close to the installation part 211 as possible, thereby minimizing flow rate loss and flow resistance of air flowing in the installation part 211.

Although not shown, the damper assembly 230 may be installed in a connection part with the first guide duct 411 connected to the second guide flow path 213 or in the first guide duct 411.

At least one cold air outlet 217 through which cold air flowing along the first guide flow path 212 is discharged to the first storage compartment 121 is formed on a front surface of the first grille assembly 210.

Next, the refrigerator according to the embodiment of the present disclosure may include a first cooling source 310.

The first cooling source 310 provides cold air.

For example, the first cooling source 310 may be configured as an evaporator forming a refrigeration cycle (not shown). In this case, the refrigeration cycle may include a compressor and a condenser, and the compressor and condenser may be located in a machine room 101 in the casing 100 (see FIG. 4).

As shown in FIG. 4, the first cooling source 310 may be disposed in a space on the rear side of the first inner casing 120. The first cooling source 310 may be disposed behind the first grille assembly 210 installed in the first inner casing 120.

The first cooling source 310 may be disposed at a lower portion than the first blowing fan 201 installed in the first grille assembly 210. The first blowing fan 201 may suck the air passing through the first cooling source 310 into the installation part 211 and then blow air to the storage compartments 121 and 131 through each guide flow path 212 and 213.

Next, the refrigerator according to the embodiment of the present disclosure may include a first heat supply unit 311.

The first heat supply unit 311 provides heat for defrosting frost formed on the first cooling source 310.

The first heat supply unit 311 may include a heater that generates heat by power supply. In this case, the first heat supply unit 311 may provide radiant heat or conductive heat to the first cooling source 310 while being positioned adjacent to the first cooling source 310.

As shown in FIG. 4, the first heat supply unit 311 may be provided below the first cooling source 310. Although not shown, the first heat supply unit 311 may be provided as at least one of various heat sources other than a heater, a heat conductor, or a conduit through which a high-temperature refrigerant flows. The first heat supply unit 311 may include a plurality of heaters, heat sources, heat conductors, and conduits.

Next, the refrigerator according to the embodiment of the present disclosure may include a first detection sensor 510.

The first detection sensor 510 is provided to determine the degree of frost or the degree of defrosting of the first cooling source 310 located in the first inner casing 120.

The first detection sensor 510 may measure a physical property value of the air passing through the first detection sensor 510 to determine the degree of frost formation or defrosting of the cooling source 310. In this case, the physical property may include at least one of a temperature, a pressure, and a flow rate.

The first detection sensor 510 may be configured as a temperature sensor that checks the temperature of the air passing through the first detection sensor 510. That is, it may be determined that the flow rate of air increases or decreases according to the temperature of the air passing through the first detection sensor 510. According to the determined increase or decrease in the air flow rate, it is possible to estimate the amount of frosting or whether the first cooling source 310 is frosted.

The first detection sensor 510 may include a heating element 511 (see FIG. 8). That is, it is possible to estimate whether the first cooling source is frosted or the frost amount of the first cooling source 310 based on the temperature difference value when the heating element 511 is turned on or off. For example, when the difference value between the maximum temperature measured while the heating element 511 is turned on and the minimum temperature measured while the heating element 511 is turned off falls within a preset difference range, it may be determined that defrosting of the first cooling source 310 is necessary. When the measured difference value is greater than the preset difference value, it may be determined that defrosting is unnecessary.

It may be determined that the greater the temperature difference value is, the more smoothly the air flows. Accordingly, it may be determined that the greater the temperature difference value is, the less or no frosting of the first cooling source 310 is.

The first detection sensor 510 may be installed at various locations.

As an example, the first detection sensor 510 may be installed on a flow path of air discharged from the first blowing fan 201 and flowing along any one of the guide flow paths 212, 213. That is, the first detection sensor 510 may be installed on the air discharge side of the first blowing fan 201.

As such, the first detection sensor 510 is not located on the air outlet side of the first cooling source 310 or between the air inlet side and the cold air outlet side, so it is less affected by the first cooling source 310.

That is, in the prior art, since the sensor for frost detecting is located between the air inlet and the air outlet of the cooling source, or is located in the flow path through which air flows to the blowing fan through the cooling source, there is a limit to the installation position of the sensor, and it is difficult to detect the degree of defrosting performed because the operation of circulating the air during the defrosting operation is not performed.

However, as in the embodiment of the present disclosure, when the first detection sensor 510 is located at the air discharge side of the first blowing fan 201, the installation location thereof is free while accurately detecting the frost of the first cooling source 310. In addition, when the air passing through the first blowing fan 201 is designed to be directly supplied to the first cooling source 310 through a separate flow path during the defrosting operation, the first detection sensor 510 may be installed in the flow path. Therefore, it is possible to check the degree of defrosting during the defrosting operation.

In addition, when the first detection sensor 510 is located at the air discharge side of the first blowing fan 201, the detection accuracy may be high because the amount of air (flowing air amount) is large. In the prior art, since a part of the air recovered to the cooling source passes through the detection sensor, the amount of air is not large, and thus the detection accuracy is not higher than when the detection sensor is located on the air discharge side of the blowing fan.

In addition, when the first detection sensor 510 is located at the air discharge side of the first blowing fan 201, it may have an advantage of easily forming the place for installation. That is, since the first detection sensor 510 may be installed on the insulating material made of Styrofoam covering the second guide flow path 213, a place for installing the first detection sensor 510 may be easily formed, and various modifications may be made as necessary.

In addition, when the first detection sensor 510 is located at the air discharge side of the first blowing fan 201, the first detection sensor 510 is not exposed to the inside of the first storage compartment 121 or the space where the first cooling source 310 is located. Therefore, it is advantageous for visual effects and damage prevention.

As such, when the first cooling source 310 is configured in a vertically long shape such as a kimchi refrigerator, it is most preferable to install the first detection sensor 510 at the air discharge side of the first blowing fan 201, as described above.

As another example, the first detection sensor 510 may be installed on at least one wall surface of the second guide flow path 213.

In this case, the first detection sensor 510 may be installed to be in close contact with the wall surface or to be spaced apart therefrom.

As another example, the first detection sensor 510 may be installed on the air outlet side of the damper assembly 230 in the second guide flow path 213. That is, the first detection sensor 510 may be configured to detect the temperature of the air passing through the second guide flow path 213 when the second guide flow path 213 is opened by the operation of the damper assembly 230.

Meanwhile, as shown in FIGS. 9 to 13, the first detection sensor 510 may include a first sensing duct 512 having an inlet through which air is introduced and an outlet through which air is discharged.

That is, by providing the first sensing duct 512 additionally, the sensing performance of the first detection sensor 510 may be improved.

The first sensing duct 512 may be provided separately from the flow path (e.g., each guide flow path 212, 213) through which air flows, and may be formed to have a separate flow path partitioned from the flow paths 212, 213.

Along with this, the first detection sensor 510 may be positioned in the first sensing duct 512 to check the temperature of the air passing through the first sensing duct 512.

When the first detection sensor 510 includes a heating element 511, the heating element 511 may be positioned on the air outlet side of the first detection sensor 510 in the first sensing duct 512. Accordingly, the first detection sensor 510 may accurately measure the temperature when the heating element 511 is turned on and off according to the flow amount of air.

When the first detection sensor 510 is installed inside the first sensing duct 512, the first sensing duct 512 may be closely attached to, or spaced apart from any one wall surface of the second guide flow path 213.

In this case, it is preferable that the air inlet side of the first sensing duct 512 is disposed to be opened in a direction opposite to the flow direction of the air flowing along the second guide flow path 213. That is, the flow direction of the air flowing along the second guide flow path 213 and the direction of the air inlet of the first sensing duct 512 face each other so that the air may sufficiently flow into the first sensing duct 512.

As another embodiment, as shown in FIG. 10, the air inlet side of the first sensing duct 512 may be formed to be opened to the inside of the installation part 211.

The air outlet side of the first sensing duct 512 may be configured to be located at various places. For example, as shown in FIG. 11, the air outlet side of the first sensing duct 512 may be located at the air inlet side of the second storage compartment 131. That is, the air outlet side of the first sensing duct 512 may be formed to be opened toward the inside of the second guide flow path 213. In this case, the air outlet side may be formed to be opened toward the lower portion in the second guide flow path 213 for smooth flow of air.

Alternatively, as shown in FIG. 12, the air outlet side of the first sensing duct 512 may be located on the air outlet side of the second storage compartment 131.

Alternatively, as shown in FIG. 13, the air outlet side of the first sensing duct 512 may be located on the air inlet side of the first cooling source 310.

Hereinafter, the operation process of the refrigerator according to the embodiment of the present disclosure will be described in detail.

First, when a condition for the cooling operation of the first storage compartment 121 is satisfied, a compressor (not shown) is driven and the first blowing fan 201 is operated. At the same time, the damper assembly 230 located in the first guide flow path 212 is opened, and the damper assembly 230 located in the second guide flow path 213 is closed.

Thus, as shown in FIGS. 14 and 15, the air generated by the operation of the first blowing fan 201 passes through the first cooling source 310 and then passes through the first blowing fan 201 to the installation part 211 formed in the first grille assembly 210. The air flowing through the installation part 211 is supplied to the first storage compartment 121 while flowing along the first guide flow path 212.

In addition, the air supplied to the first storage compartment 121 is circulated in the first storage compartment 121 and then recovered to the air inlet side of the first cooling source 310 through a recovery duct (not shown). The air recovered to the air inlet side of the first cooling source 310 is heat-exchanged while passing through the first cooling source 310, and then flows through the first blowing fan 201 repeatedly.

When the inside of the first storage compartment 121 satisfies a cooling end condition, the compressor is stopped, the first blowing fan 201 is stopped, and the damper assembly 230 located in the first guide flow path 212 is closed.

Next, when a condition for the cooling operation of the second storage compartment 131 is satisfied, the compressor is driven and the first blowing fan 201 is operated. When the condition for the cooling operation of the second storage compartment 131 is satisfied, the damper assembly 230 located in the first guide flow path 212 is closed, and the damper assembly 230 located in the second guide flow path 213 is opened.

Thus, as shown in FIGS. 16 and 17, the air generated by the operation of the first blowing fan 201 flows through the first cooling source 310 and then through the first blowing fan 201 to the installation part 211 formed in the first grille assembly 210. And then, the air flows sequentially along the second guide flow path 213 and the first guide duct 411 and is supplied to the second storage compartment 131.

In addition, the air supplied to the second storage compartment 131 is circulated in the second storage compartment 131 and is recovered to the air inlet side of the first cooling source 310 through the first recovery duct 412. The air recovered to the air inlet side of the first cooling source 310 is heat-exchanged while passing through the first cooling source 310, and then flows through the first blowing fan 201 repeatedly.

When the inside of the second storage compartment 131 satisfies a cooling end condition, the compressor is stopped, the first blowing fan 201 is stopped, and the damper assembly 230 located in the second guide flow path 212 is operated to block the air flow passing through the second guide flow path 213.

Meanwhile, when the cooling operation (specifically, the cooling operation of the second storage compartment) is performed for each storage compartment 121, 131, frost detection is performed periodically or aperiodically by the first detection sensor 510.

When the frost detection is performed, the heating element 511 is controlled to be turned on and off, and a temperature difference value is checked when the heating element 511 is turned on and off by the first detection sensor 510.

When the checked temperature difference value is included in a preset difference value, it is determined that the defrosting operation is necessary. When the checked temperature difference value is greater than the preset difference value, it is determined that the defrosting operation is unnecessary.

When it is determined that the defrosting operation is necessary, the cooling operation of each of the storage compartments 121 and 131 ends, and the defrosting heat by the first heat supply unit 311 is provided to the first cooling source 310.

Accordingly, the defrosting operation for the first cooling source 310 is performed, and when the end condition of the defrosting operation is satisfied, the supply of heat for defrosting by the first heat supply unit 311 is stopped. In this case, the end condition of the defrosting operation may include at least one of a condition according to time, a condition according to the temperature of the first cooling source 310, or a condition in which the temperature difference value measured by the first detection sensor 510 is greater than a preset difference value.

Then, when the defrosting operation of the first cooling source 310 is ended, the cooling operation for each of the storage compartments 121 and 131 is repeated or performed according to a condition.

Meanwhile, in addition to the first and second inner casings 120 and 130, the refrigerator of the present disclosure may further include a third inner casing 140 defining a third storage compartment 141 and a fourth inner casing 150 defining a fourth storage compartment 151, as shown in FIGS. 18 and 19.

As an example, the third inner casing 140 may be located on the side of the first inner casing 120 and above the second inner casing 130. The fourth inner casing 150 may be located on the lower side of the second inner case 130. Although not shown, the third inner casing 140 and the fourth inner casing 150 may be positioned differently from the above example.

A second grille assembly 220 having a second blowing fan 202 may be provided in the third inner casing 140.

A second cooling source 320 for generating cold air and a second heat supply unit 321 for providing heat to the second cooling source 320 may be further provided in the third inner casing 140.

The second cooling source 320 may be provided in the front side of the rear wall surface of the third inner casing 140.

The second grille assembly 220 may be provided in front of the second cooling source 320. The second heat supply unit 321 may be provided below the second cooling source 320.

The second grille assembly 220 may selectively supply air to the third storage compartment 141 of the third inner casing 140 and the fourth storage compartment 151 of the fourth inner case 150.

The second grill assembly 220 may be formed in the same manner as the first grill assembly 210 described above.

However, the second grill assembly 220 may be formed in a different shape from the first grille assembly 210 described above.

For example, as shown in FIG. 20, a first guide flow path 222 formed in the second grille assembly 220 may extend to supply air to the third storage compartment 141 from an installation part 221 recessed to install the second blowing fan 202. In this case, while a damper assembly 230 is provided in the first guide flow path 222, the air flow may be opened and closed by the damper assembly 230.

For example, as shown in FIG. 20, a second guide flow path 223 formed in the second grille assembly 220 may extend to supply air from the installation part 221 to the fourth storage compartment 151. In this case, while the damper assembly 230 is provided in the second guide flow path 223, the air flow may be opened and closed by the damper assembly 230.

The second guide flow path 223 may be connected to supply air to the fourth storage compartment 151 through a second guide duct 421. The air circulated in the fourth storage compartment 151 may be recovered to an air inlet side of the second cooling source 320 through a second recovery duct 422.

The damper assembly 230 may have substantially the same structure as the damper assembly 230 provided to the first grille assembly 210. Of course, depending on the position or shape of the area where the corresponding damper assembly 230 is installed, the shape, position, or size of the housing or gate constituting the exterior thereof may be partially changed.

In addition, as shown in FIG. 20, the second guide flow path 223 formed in the second grille assembly 220 may extend to the lower side of the installation part 221. An upper end of the second guide flow path 223 may be connected to an inner space of the installation part 221.

The damper assembly 230 may be positioned between the second guide flow path 223 and the installation part 221.

One end of the second guide duct 421 may be connected to the lower end of the second guide flow path 223. The other end of the second guide duct 421 may be connected to the fourth storage compartment 151 of the fourth inner casing 150. Thus, the air flowing along the second guide flow path 223 may be provided to the fourth storage compartment 151 under the guidance of the second guide duct 421.

The other end of the second guide duct 421 may be connected to a front side of the upper surface of the fourth inner casing 150.

On the front surface of the second grille assembly 220, at least one cold air outlet 227 is formed to discharge the air flowing along the first guide flow path 222 to the third storage compartment 141 is formed (see FIG. 2).

As shown in FIGS. 19 to 21, a second detection sensor 520 may be disposed in the second grille assembly 220.

The second detection sensor 520 determines the degree of frost or the degree of defrosting of the second cooling source 320 located in the third inner casing 130.

The second detection sensor 520 may measure a physical property value of the air passing through the second detection sensor 520 to determine the degree of frost formation or defrosting of the second cooling source 320. In this case, the physical property may include at least one of a temperature, a pressure, and a flow rate.

The second detection sensor 520 may be configured as a temperature sensor that checks the temperature of the air passing through the second detection sensor 520. That is, it may be determined that the flow rate of air is increased or decreased according to the temperature of the air passing through the second detection sensor 520. According to the determined increase or decrease in the air flow rate, it is possible to estimate the amount of frosting or whether the second cooling source 320 is frosted.

The second detection sensor 520 may further include a heating element 521.

That is, it may be determined whether defrosting operation is necessary, based on a temperature difference value when the heating element 521 is turned on or off. For example, when the difference between the temperature (maximum temperature and minimum temperature) measured while the heating element 521 is turned on and the temperature (maximum temperature and minimum temperature) measured while the heating element 521 is turned off falls within a preset difference range, it may be determined that defrosting of the second cooling source 310 is necessary. When the difference value between the measured temperatures is greater than the preset difference value, it may be determined that defrosting is not necessary. That is, the greater the temperature difference value is, the more smoothly the air flows, and accordingly, it may be determined that there is no or insignificant amount of frost of the second cooling source 320.

As an example, the second detection sensor 520 may be located on a flow path of air discharged from the second blowing fan 202 and flowing along any one of the guide flow paths 222, 223 of the second grille assembly 220. For example, the second detection sensor 520 may be located on the air discharge side of the second blowing fan 202. As such, since the second detection sensor 520 is not located on the cold air outlet side or between the cold air inlet side and the cold air outlet side of the second cooling source 320, it is less affected by the second cooling source 320.

As another example, the second detection sensor 520 may be installed on at least one wall in the second guide flow path 223. The second detection sensor 520 may be in contact with or spaced apart from the wall surface.

As another example, the second detection sensor 520 may be installed on the air outlet side of the damper assembly 230 in the second guide flow path 223. That is, when the second guide flow path 223 is opened by the operation of the damper assembly 230, the second detection sensor 520 may detect the temperature of the air passing through the second guide flow path 223.

As shown in FIG. 22, the second detection sensor 520 may be located in a second sensing duct 522 having an inlet through which air is introduced and an outlet through which air is discharged.

That is, the detection performance of the second detection sensor 520 may be improved by additionally providing the second sensing duct 522.

The second sensing duct 522 may be provided separately from the flow paths (e.g., each guide flow path) 222 and 223 through which air flows, and may be formed to have a separate flow path separated from the flow paths 222, 223.

The second detection sensor 520 may be located in the second sensing duct 522 to check the temperature of air passing through the second sensing duct 522.

When the second detection sensor 520 includes the heating element 521, the heating element 521 may be positioned on the second detection sensor 520 in the second sensing duct 522. Thus, the second detection sensor 520 may accurately measure the temperature when the heating element 521 is turned on or off according to the amount of air flow.

The second sensing duct 522 may have an inlet and an outlet located in the vertical direction of the second guide flow path 223. That is, a part of the air flowing along the second guide flow path 223 may pass through the first sensing duct 522 due to a sagging phenomenon (a phenomenon of sinking downward with moisture contained in the air). Accordingly, air may smoothly pass through the first sensing duct 522 without performing excessive air blowing.

Of course, the air outlet side of the second sensing duct 522 may be located in various other places.

As an example, as shown in FIG. 23, the air outlet side of the second sensing duct 522 may be located on the air inlet side of the fourth storage compartment 151. That is, the air outlet side of the second sensing duct 522 may be formed to be opened toward the inside of the second guide flow path 223. In this case, the air outlet side may be formed to be opened toward the lower portion in the second guide flow path 223 so that the air flows down smoothly.

As another example, as shown in FIG. 24, the air outlet side of the second sensing duct 522 may be located on the air outlet side of the fourth storage compartment 151.

As another example, as shown in FIG. 25, the air outlet side of the second sensing duct 522 may be located on the air inlet side of the second cooling source 320.

Meanwhile, the attached FIGS. 26 and 27 illustrate the air flow during operation for cooling the third storage compartment 141.

That is, during the cooling operation of the third storage compartment 141, the air passing through the second cooling source 320 by the operation of the second blowing fan 202 is provided to the third storage compartment 141 through the first guide flow path 222.

The air circulating in the third storage compartment 141 is recovered to the air inlet side of the second cooling source 320. The recovered air sequentially passes through the second cooling source 320 and the second blowing fan 202 and is provided to the e third storage compartment 141, and the circulation process is repeated.

In addition, FIGS. 28 and 29 attached show air flow during operation for cooling the fourth storage compartment 151.

That is, during the cooling operation of the fourth storage compartment 151, air passing through the second cooling source 320 by the operation of the second blowing fan 202 is provided to the fourth storage compartment 151 through the second guide flow path 223.

The air circulating in the fourth storage compartment 151 is recovered to the air inlet side of the second cooling source 320. The recovered air sequentially passes through the second cooling source 320 and the second blowing fan 202 and is provided to the fourth storage compartment 151, and the circulation process is repeated.

In addition, during the above-described cooling operation for each of the storage compartments 141 and 151, frost detection of the second cooling source 320 is performed periodically or aperiodically by the second detection sensor 520.

When it is determined that the defrosting operation of the second cooling source 320 is necessary, the cooling operation of each storage compartment 141, 151 is ended, and the defrosting operation of the second cooling source 320 is performed by providing the defrosting heat by the second heat supply unit 321 to the second cooling source 320.

Meanwhile, the refrigerator of the present disclosure may be implemented in various structures different from those of the above-described embodiment.

As an example, a third guide flow path 214 may be further formed in the first grille assembly 210 as shown in FIGS. 30 to 33.

In this case, the third guide flow path 214 is a flow path for guiding (bypassing) the air flow from the installation part 211 to the air inlet side of the first cooling source 310.

That is, by additionally providing the third guide flow path 214, it is possible for air to repeatedly circulate only between the first blowing fan 201 and the first cooling source 310. In particular, during the defrosting operation of the first cooling source 310, the air blown by the operation of the first blowing fan 201 flows repeatedly only to the first cooling source 310 through the installation part 211 and the third guide flow path 214, so that the defrosting of the first cooling source 310 may be performed more quickly with the air.

In one example, the first detection sensor 510 may be provided in the third guide flow path 214. Although not shown, a separate first detection sensor 510 may be further provided in the second guide flow path 213.

For example, the first detection sensor 510 may be installed on at least one wall surface in the third guide flow path 214.

Of course, as shown in FIG. 33, the third guide flow path 214 may be provided with the damper assembly 230 that opens and closes the third guide flow path 214. In this case, the first detection sensor 510 may be installed on the air outlet side of the damper assembly 230.

In addition, as shown in FIGS. 34 and 35, the first detection sensor 510 may be installed in the first sensing duct 512 having a flow path separated from the third guide flow path 214.

When the first detection sensor 510 is installed in the first sensing duct 512, the air inlet side of the first sensing duct 512 may be formed to be opened to the inside of the installation part 211.

In addition, when the first detection sensor 510 is installed in the first sensing duct 512, the air outlet side of the first sensing duct 512 may be formed or positioned to be opened to the air inlet side of the first cooling source 310.

As another example, a third guide flow path 224 may be further formed in the second grille assembly 220 as shown in FIGS. 36 to 38.

In this case, the third guide flow path 224 guides the air flow from the installation part 221 to the air inlet side of the second cooling source 320.

That is, by additionally providing the third guide flow path 224, it is possible for air to repeatedly circulate only between the second blowing fan 202 and the second cooling source 320. In particular, during the defrosting operation of the second cooling source 320, the air blown by the operation of the second blowing fan 202 flows repeatedly only to the second cooling source 320 through the installation part 221 and the third guide flow path 224. Accordingly, the defrosting of the second cooling source 320 may be performed more quickly with the air.

In another example, the second detection sensor 520 may be provided in the third guide flow path 224. Although not shown, a separate second detection sensor 520 may be provided in the second guide flow path 223.

For example, the second detection sensor 520 may be installed on at least one wall surface in the third guide flow path 224.

Of course, as shown in FIG. 39, a damper assembly 230 may be provided in the third guide flow path 224 to open and close the corresponding flow path. In this case, the second detection sensor 520 may be installed on the air outlet side of the damper assembly 230.

As shown in FIG. 40, the second detection sensor 520 may be installed in the second sensing duct 522 having a flow path separated from the third guide flow path 224.

In this way, when the second detection sensor 520 is installed in the second sensing duct 522, the air inlet side of the second sensing duct 522 may be formed to be opened to the inside of the installation part 221.

When the second detection sensor 520 is installed in the second sensing duct 522, the air outlet side of the second sensing duct 522 may be formed or positioned to be opened toward the air inlet side of the second cooling source 320.

As described above, the refrigerator of the present disclosure may be implemented in various ways.

As described above, in the refrigerator of the present disclosure, detection sensors 510, 520 for detecting frost formation or defrosting are located on the air discharge side of the blowing fans 201, 202 for air blowing. As a result, sufficient air flows to the detection sensors 510, 520, and the frost formation of the cooling sources 310, 320 may be accurately detected.

In the refrigerator of the present disclosure, detection sensors 510, 520 are located at a portion where air flows from top to bottom. Accordingly, even if the amount of air blowing is small, the frost formation of the cooling sources 310, 320 may be accurately detected.

In the refrigerator of the present disclosure, the defrosting end time of the cooling sources 310, 320 is determined by the temperature of the air flowing into the cooling sources 310, 320. Accordingly, the defrosting end time may be accurately determined.

In the refrigerator of the present disclosure, the detection sensors 510, 520 are located in sensing ducts 512, 522. Accordingly, it is possible to accurately determine whether or not frost is formed in the cooling sources 310 and 320 even with a small amount of air.

In the refrigerator of the present disclosure, both ends of the sensing ducts 512, 522 are opened to the air inlets of the installation parts 211, 221 of the grille assemblies 210, 220 and the cooling sources 310, 320. As a result, even if the guide flow paths 212, 213, 222, and 223 are closed by the closing operation of each damper assembly 230, the frost of the cooling sources 310, 320 may be detected.

In the refrigerator of the present disclosure, apart from the flow paths 212, 213, 222, and 223 for cooling, the third guide flow paths 214, 224 bypassed directly toward the air inlet side of the cooling sources 310, 320 are provided. The third guide flow paths 214, 224 are opened and closed respectively by the damper assembly 230, and the detection sensors 510, 520 may be installed in the third guide flow paths 214, 224. In this way, it is possible not only to detect frosting, but also to detect whether or not it is defrosted.

In the refrigerator of the present disclosure, when the defrosting operation is performed, air is repeatedly supplied to the cooling sources 310, 320. Accordingly, defrosting of the cooling sources 310, 320 may be performed more quickly, and power consumption may be reduced.

Meanwhile, each component constituting the refrigerator of the present disclosure may be provided including all, or only some of the components may be provided.

In addition, each component may be provided in the same number as shown in the drawings of the embodiment, or more may be provided.

For example, three or more storage compartments may be provided. In this case, three or more guide flow paths for guiding air from the installation part to each storage compartment may be provided. Three or more damper assemblies may also be provided to be positioned in each guide flow path.

As such, although not shown, the refrigerator of the present disclosure may be implemented in various forms.

The invention claimed is:

1. A refrigerator comprising:

a casing having a first storage compartment and a second storage compartment;

a grille assembly installed at one side of the first storage compartment and having a blowing fan installed therein to discharge air heat-exchanged with a cooling source to at least one storage compartment among the first storage compartment and the second storage compartment; and a heat supply unit for defrosting the cooling source, wherein the grille assembly comprises:

an installation part for accommodating the blowing fan;

a first guide flow path for guiding air flow from the blowing fan at the installation part to the first storage compartment;

a second guide flow path for guiding air flow from the blowing fan at the installation part to the second storage compartment;

a first damper located at the first guide flow path for opening and closing the first guide path;

a second damper located at the second guide flow path for opening and closing the second guide flow path; and a detection sensor installed at an air discharge side of the blowing fan for detecting a degree of frosting or a degree of defrosting of the cooling source, wherein the detection sensor is installed in at least one part of the second guide flow path, wherein the second damper is in the second guide flow path, wherein the second damper is disposed adjacent to a boundary between the second guide flow path and the installation part or adjacent to the installation part in the second guide flow path, and wherein the detection sensor is installed at an air outlet side of the second damper in the second guide flow path.

2. The refrigerator of claim 1, wherein the detection sensor detects the degree of frosting or the degree of defrosting of the cooling source by measuring at least one physical property value among a temperature, a pressure, and a flow rate of air passing through the detection sensor.

3. The refrigerator of claim 1, wherein the second guide flow path is installed at a side of the installation part and guides the air flow to the second storage compartment.

4. The refrigerator of claim 1, wherein the second guide flow path is installed at a lower side of the installation part and guides the air flow to the second storage compartment.

5. The refrigerator of claim 1, wherein the detection sensor is installed in a sensing duct having a flow path that is partitioned from the second guide flow path.

6. The refrigerator of claim 5, wherein an air inlet side of the sensing duct is opened toward a direction that is different to a flow direction of the air flow in the second guide flow path.

7. The refrigerator of claim 5, wherein an air inlet side of the sensing duct is opened toward an upper part of the second guide flow path.

8. The refrigerator of claim 5, wherein an air inlet side of the sensing duct is installed at an air outlet side of the second damper at the second guide flow path.

9. The refrigerator of claim 5, wherein an air inlet side of the sensing duct is opened to an inside of the installation part.

10. The refrigerator of claim 9, wherein an air outlet side of the sensing duct is opened to an air inlet side of the cooling source.

11. The refrigerator of claim 9, wherein an air outlet side of the sensing duct is opened to the second guide flow path.

12. The refrigerator of claim 5, wherein an air outlet side of the sensing duct is opened toward a direction corresponding to a flow direction of the air flow in the second guide flow path.

13. The refrigerator of claim 1, wherein an air outlet side of the sensing duct is opened toward a lower part in the second guide flow path.

14. The refrigerator of claim 1, wherein the grille assembly further has a third guide flow path for guiding the air flow from the blowing fan at the installation part to an air inlet side of the cooling source.

15. The refrigerator of claim 14, wherein the detection sensor is installed in at least one part in the third guide flow path.

16. The refrigerator of claim 14, comprises a third damper located at the third guide path for opening and closing the third guide flow path.

17. The refrigerator of claim 16, wherein the detection sensor is installed at an air outlet side of the third damper at the third guide flow path.

18. The refrigerator of claim 14, wherein the detection sensor is installed in a sensing duct having a flow path that is partitioned from the third guide flow path.

19. The refrigerator of claim 18, wherein an air inlet side of the sensing duct is opened to an inside of the installation part.

20. The refrigerator of claim 18, wherein an air outlet side of the sensing duct is opened to an air inlet side of the cooling source.

21. A refrigerator comprising:

a casing having two or more storage compartments;

a grille assembly having a blowing fan for supplying air heat-exchanged with a cooling source to at least one of the storage compartments; and a heat supply unit for defrosting the cooling source, wherein the grille assembly comprises:

an installation part for accommodating the blowing fan;

a plurality of guide flow paths for guiding air flow from blowing fan at the installation part to a corresponding storage compartment;

a damper located at each guide flow path for opening and closing corresponding guide flow path; and a detection sensor installed at an air discharge side of the blowing fan for detecting a degree of frosting or a degree of defrosting of the cooling source, wherein the grille assembly has another guide flow path for guiding the air flow from the blowing fan at the installation part to an air inlet side of the cooling source, wherein the detection sensor is installed in at least one part of the another guide flow path, wherein the grille assembly has another damper located at the another guide path for opening and closing the another guide flow path, and wherein the detection sensor is installed at an air outlet side of the another damper at the another guide flow path.

* * * * *